US010829355B2

(12) United States Patent
Puszkiewicz et al.

(10) Patent No.: US 10,829,355 B2
(45) Date of Patent: Nov. 10, 2020

(54) SCISSOR DECK ACCESS ARRANGEMENT

(71) Applicant: Oshkosh Corporation, Oshkosh, WI (US)

(72) Inventors: Ignacy Puszkiewicz, Hagerstown, MD (US); Zachary C. Foster, Oshkosh, WI (US); Evan J. Hummer, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

(21) Appl. No.: 16/459,295

(22) Filed: Jul. 1, 2019

(65) Prior Publication Data

US 2019/0322512 A1 Oct. 24, 2019

Related U.S. Application Data

(63) Continuation of application No. 15/789,005, filed on Oct. 20, 2017, now Pat. No. 10,336,596.

(51) Int. Cl.

| | |
|---|---|
| ***E04C 1/00*** | (2006.01) |
| ***B66F 13/00*** | (2006.01) |
| ***B66F 11/04*** | (2006.01) |

(52) U.S. Cl.

CPC ..... *B66F 13/00* (2013.01); *B66F 11/042* (2013.01)

(58) Field of Classification Search

CPC ..... B66F 13/00; B66F 11/042; E06C 5/00; E06C 5/02; E06C 5/24; B60R 3/00; B60R 3/007

See application file for complete search history.

(56) References Cited

U.S. PATENT DOCUMENTS

| | | | | |
|---|---|---|---|---|
| 6,155 A * | 3/1849 | Huffman et al. | ..... | B66F 11/042 182/69.1 |
| 3,664,458 A * | 5/1972 | Sterns | ..... | E06C 1/39 182/102 |
| 3,889,778 A | 6/1975 | Dotts | | |
| 3,920,096 A * | 11/1975 | Fisher | ..... | B66F 11/042 182/69.5 |
| 4,375,248 A * | 3/1983 | Kishi | ..... | E04G 1/22 182/141 |
| 4,390,080 A | 6/1983 | Bushnell, Jr. | | |

(Continued)

FOREIGN PATENT DOCUMENTS

WO WO-2017/177174 10/2017

OTHER PUBLICATIONS

International Search Report and Written Opinion Received for PCT Application No. PCT/US2018/056652, Oshkosh Corporation, dated Jan. 4, 2019, 15 pages.

*Primary Examiner* — Jerry E Redman
(74) *Attorney, Agent, or Firm* — Foley & Lardner LLP

(57) ABSTRACT

A lift device includes a chassis, a platform disposed above the chassis, a lift assembly coupling the platform to the chassis and configured to move the platform between a lowered position and a raised position, and a stair assembly coupled to at least one of the platform and the chassis, the stair assembly including a first step and a second step. The platform includes a deck defining a top surface configured to support an operator. The stair assembly is selectively repositionable relative to the chassis between a stored position and a deployed position. The stair assembly facilitates access to the deck from the ground when in the deployed position.

14 Claims, 18 Drawing Sheets

(56) References Cited

U.S. PATENT DOCUMENTS 4,427,093 A * 1/1984 Wehmeyer ..... E04G 1/22 182/141
4,457,403 A 7/1984 Ream
5,111,907 A * 5/1992 Kishi ..... B66F 11/04 182/69.4
5,555,953 A * 9/1996 Henderson ..... B66F 11/044 182/118
5,588,500 A * 12/1996 Yonahara ..... E04G 1/22 182/141
6,003,633 A * 12/1999 Rolson ..... E06C 5/02 182/106
6,598,704 B2 * 7/2003 Hansen ..... B60R 3/005 108/134
6,883,641 B2 * 4/2005 Julien ..... B66F 11/042 182/141
7,828,116 B2 * 11/2010 Vetesnik ..... A62B 1/04 182/115
8,590,921 B2 * 11/2013 Benson ..... B62B 3/008 182/123
8,622,173 B2 * 1/2014 Fuqua ..... B60R 3/005 182/63.1
8,746,403 B1 * 6/2014 Tyner ..... E06C 1/30 182/106
8,910,749 B1 * 12/2014 Jensen ..... B66F 11/042 182/69.5
8,931,792 B1 * 1/2015 Klassen ..... B60R 3/02 182/65.1
9,133,014 B2 * 9/2015 Kenan ..... B67D 7/40
9,492,695 B2 * 11/2016 Betz ..... E06C 5/04
9,580,962 B2 * 2/2017 Betz ..... A62C 27/00
9,731,640 B1 * 8/2017 Meacham ..... B60R 3/00
9,776,846 B2 10/2017 Ditty
9,791,071 B2 10/2017 Ditty et al.
9,902,577 B2 * 2/2018 Honeycutt ..... E06C 5/02
10,479,664 B2 * 11/2019 Linsmeier ..... A62C 27/00
2005/0247517 A1 * 11/2005 Vetesnik ..... A62B 1/04 182/12
2008/0063498 A1 * 3/2008 Lambert ..... B66F 11/04 414/540
2011/0253476 A1 10/2011 Earl et al.
2012/0006619 A1 * 1/2012 DuBose ..... B60P 1/00 182/113
2014/0041963 A1 * 2/2014 O'Shea ..... E06C 1/393 182/64.1
2014/0239609 A1 * 8/2014 Robertson ..... B60R 3/02 280/166
2016/0138338 A1 * 5/2016 Olson ..... E06C 1/39 182/113
2016/0145939 A1 * 5/2016 Smith ..... E06C 1/393 182/113
2016/0244252 A1 * 8/2016 Beard ..... B60P 3/2245
2016/0311253 A1 10/2016 Palmer et al.
2017/0101297 A1 * 4/2017 Claypool ..... B60M 1/28
2017/0190293 A1 * 7/2017 Koga ..... B60R 3/00
2017/0233232 A1 8/2017 Davis et al.
2017/0291802 A1 10/2017 Hao et al.
2017/0291805 A1 10/2017 Hao et al.
2018/0022591 A1 * 1/2018 Xu ..... B66F 9/07568 182/69.5
2019/0047458 A1 * 2/2019 Hall, Jr. ..... B66F 7/0683
2019/0119088 A1 * 4/2019 Puszkiewicz ..... B66F 11/042
2019/0309845 A1 * 10/2019 Clark ..... F16H 61/4035

* cited by examiner

SCISSOR DECK ACCESS ARRANGEMENT

CROSS-REFERENCE TO RELATED PATENT APPLICATION

This application is a continuation of U.S. application Ser. No. 15/789,005, filed Oct. 20, 2017, now U.S. Pat. No. 10,336,596, which is incorporated herein by reference in its entirety.

BACKGROUND

Certain aerial work platforms, known as scissor lifts, incorporate a frame assembly that supports a platform. The platform is coupled to the frame assembly using a system of linked supports arranged in a crossed pattern, forming a scissor assembly. As the supports rotate relative to one another, the scissor assembly extends or retracts, raising or lowering the platform relative to the frame. Accordingly, the platform moves primarily or entirely vertically relative to the frame assembly. Scissor lifts are commonly used where scaffolding or a ladder might be used, as they provide a relatively large platform from which to work that can be quickly and easily adjusted to a broad range of heights. Scissor lifts are commonly used for painting, construction projects, accessing high shelves, changing lights, and maintaining equipment located above the ground.

Because the scissor assembly requires a certain amount of vertical space, even when collapsed, the platform is raised above the ground when in a fully collapsed position. To facilitate access to the platform, scissor lifts conventionally include a ladder assembly fixedly coupled to a side of the frame assembly. To avoid enlarging the footprint of the scissor lift, these ladder assemblies conventionally include steps that are disposed directly above one another and directly beneath the platform. Operators often scale these ladder assemblies multiple times per day when taking breaks, bringing additional materials, and changing tasks.

SUMMARY

One exemplary embodiment relates to a lift device including a chassis, a platform disposed above the chassis, a lift assembly coupling the platform to the chassis and configured to move the platform between a lowered position and a raised position, and a stair assembly coupled to at least one of the platform and the chassis, the stair assembly including a first step and a second step. The platform includes a deck defining a top surface configured to support an operator. The stair assembly is selectively repositionable relative to the chassis between a stored position and a deployed position. The stair assembly facilitates access to the deck from the ground when in the deployed position.

Another exemplary embodiment relates to a lift device including a frame assembly, a platform disposed directly above the frame assembly, a scissor assembly coupling the platform to the frame assembly and configured to move the platform between a lowered position and a raised position, and a stair assembly coupled to at least one of the platform and the frame assembly. The platform includes a deck defining a top surface configured to support an operator. The stair assembly includes a first support and a second support extending substantially parallel to one another. The stair assembly is selectively repositionable relative to the frame assembly between a stored position and a deployed position. The stair assembly facilitates access to the deck from the ground when in the deployed position.

Yet another exemplary embodiment relates to a method of providing access to a platform of a lift device including providing a stair assembly including a first support and a second support extending parallel to one another and pivotally coupling the stair assembly to a frame assembly of the lift device such that the stair assembly is selectively rotatable relative to the frame assembly about a vertical axis between a stored position and a deployed position. The stair assembly facilitates access to the platform from the ground in the deployed position. The first support extends farther outward horizontally than the second support relative to the frame assembly when the stair assembly is in the deployed position. The first support extends farther outward horizontally relative to the frame assembly when the stair assembly is in the deployed position than when the stair assembly is in the stored position.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a lift device includes various components that improve performance relative to traditional systems. The lift device includes a chassis supported by a number of tractive assemblies. The tractive assemblies facilitate powered motion of the lift device in a longitudinal direction. The lift device includes a horizontally extending platform configured to support operators and/or equipment. A lift assembly couples the platform to the chassis and is configured to selectively reposition the platform between a raised position and a lowered position. In the lowered position, the platform remains raised a distance off of the ground.

The lift device includes an access assembly including a stair assembly and a ladder assembly. The stair assembly includes a number of stairs and a railing arranged on one or both sides of the stairs. The stairs of the stair assembly are arranged along an incline to facilitate movement of an operator up or down the stairs while carrying equipment. The stair assembly is selectively rotatable about a vertical axis relative to the chassis between a stored position and an extended position. In the stored position, the stairs extend directly beneath the platform to reduce the overall size (e.g., width, etc.) of the lift device. In the deployed position, the stair assembly rotates out to face perpendicular to the chassis, facilitating access to the platform from the ground. The ladder assembly includes a number of rungs arranged vertically directly above and below one another. A first subset of the rungs is fixedly coupled to the chassis. A second subset of the rungs is fixedly coupled to the stair assembly. With the stair assembly in the stored position, both subsets of rungs align, facilitating access to the platform using the ladder assembly. In this configuration, all of the rungs may be disposed directly beneath the platform such that the ladder assembly does not enlarge the footprint (e.g., width, etc.) of the lift device. When the stair assembly rotates to the deployed position, the second subset of the rungs rotates away from the first subset of the rungs, and the stair assembly extends in front of the first subset of rungs, preventing use of the ladder assembly.

Figure 1:
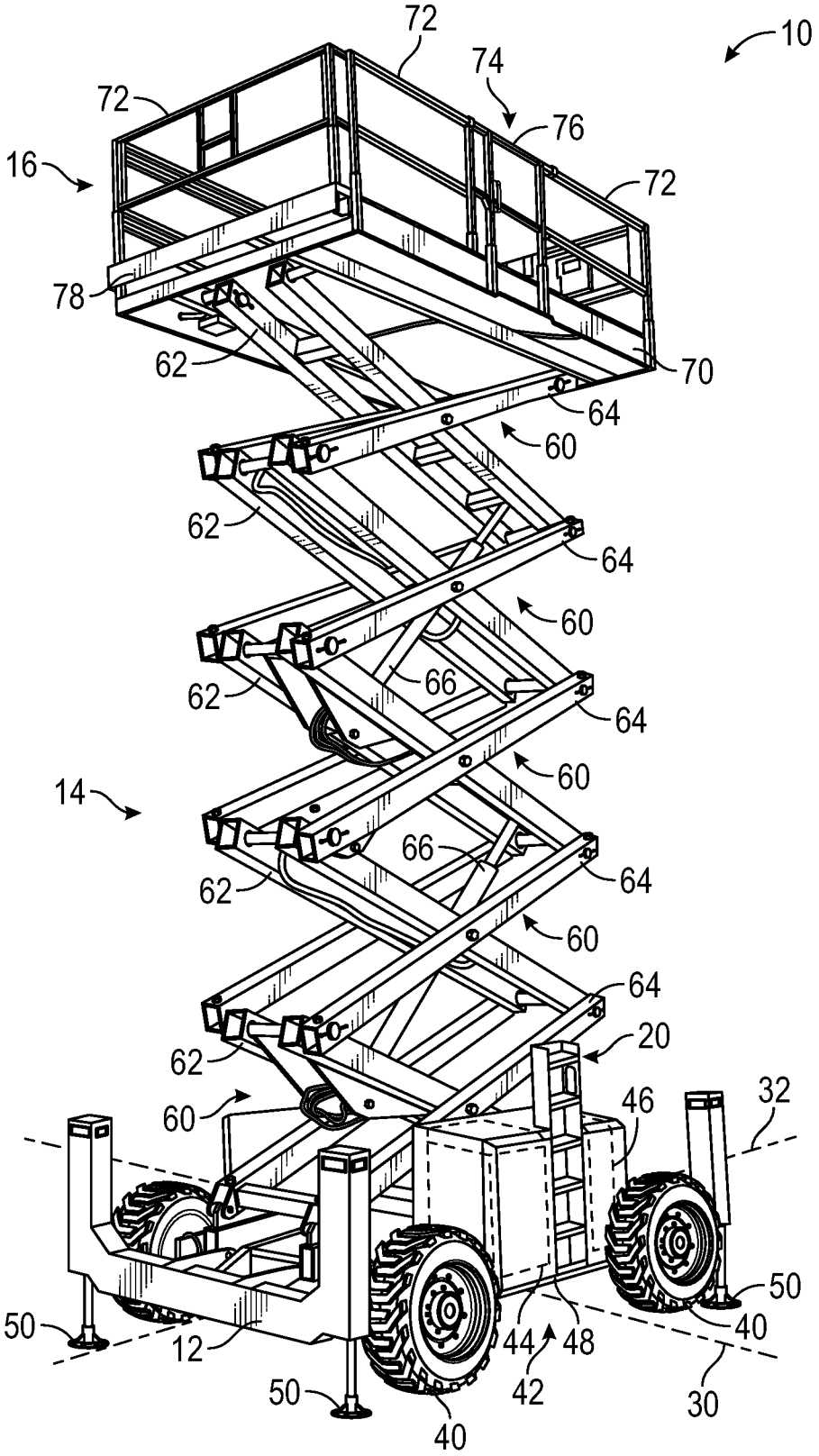
FIG. 1 is a perspective view of a lift device, according to an exemplary embodiment.

According to the exemplary embodiment shown in FIG. 1, a lift device (e.g., a scissor lift, an aerial work platform, a boom lift, a telehandler, etc.), shown as lift device 10, includes a chassis, shown as frame assembly 12. A lift device (e.g., a scissor assembly, a boom assembly, etc.), shown as lift assembly 14, couples the frame assembly 12 to a platform, shown as platform 16. The frame assembly 12 supports the lift assembly 14 and the platform 16, both of which are disposed directly above the frame assembly 12. In use, the lift assembly 14 extends and retracts to raise and lower the platform 16 relative to the frame assembly 12 between a lowered position and a raised position. The lift device 10 includes an access assembly, shown as an access assembly 20, that is coupled to the frame assembly 12 and configured to facilitate access to the platform 16 from the ground by an operator when the platform 16 is in the lowered position.

Referring again to FIG. 1, the frame assembly 12 defines a horizontal plane having a lateral axis 30 and a longitudinal axis 32. In some embodiments, the frame assembly 12 is rectangular, defining lateral sides extending parallel to the lateral axis 30 and longitudinal sides extending parallel to the longitudinal axis 32. In some embodiments, the frame assembly 12 is longer in a longitudinal direction than in a lateral direction. In some embodiments, the lift device 10 is configured to be stationary or semi-permanent (e.g., a system that is installed in one location at a work site for the duration of a construction project). In such embodiments, the frame assembly 12 may be configured to rest directly on the ground and/or the lift device 10 may not provide powered movement across the ground. In other embodiments, the lift device 10 is configured to be moved frequently (e.g., to work on different tasks, to continue the same task in multiple locations, to travel across a job site, etc.). Such embodiments may include systems that provide powered movement across the ground.

Referring to FIG. 1, the lift device 10 is supported by a plurality of tractive assemblies 40, each including a tractive element (e.g., a tire, a track, etc.), that are rotatably coupled to the frame assembly 12. The tractive assemblies 40 may be powered or unpowered. As shown in FIG. 1, the tractive assemblies 40 are configured to provide powered motion in the direction of the longitudinal axis 32. One or more of the tractive assemblies 40 may be turnable to steer the lift device 10. In some embodiments, the lift device 10 includes a powertrain system 42. In some embodiments, the powertrain system 42 includes a primary driver 44 (e.g., an engine). A transmission may receive the mechanical energy and provide an output to one or more of the tractive assemblies 40. In some embodiments, the powertrain system 42 includes a pump 46 configured to receive mechanical energy from the primary driver 44 and output a pressurized flow of hydraulic fluid. The pump 46 may supply mechanical energy (e.g., through a pressurized flow of hydraulic fluid) to individual motive drivers (e.g., hydraulic motors) configured to facilitate independently driving each of the tractive assemblies 40. In other embodiments, the powertrain system 42 includes an energy storage device (e.g., a battery, capacitors, ultra-capacitors, etc.) and/or is electrically coupled to an outside source of electrical energy (e.g., a standard power outlet). In some such embodiments, one or more of the tractive assemblies 40 include an individual motive driver (e.g., a motor that is electrically coupled to the energy storage device, etc.) configured to facilitate independently driving each of the tractive assemblies 40. The outside source of electrical energy may charge the energy storage device or power the motive drivers directly. The powertrain system 42 may additionally or alternatively provide mechanical energy (e.g., using the pump 46, by supplying electrical energy, etc.) to one or more actuators of the lift device 10 (e.g., the leveling actuators 50, the lift actuators 66, the stair actuator 230, etc.). One or more components of the powertrain system 42 may be housed in an enclosure, shown as housing 48. The housing 48 is coupled to the frame assembly 12 and extends from a side of the lift device 10 (e.g., a left or right side). The housing 48 may include one or more doors to facilitate access to components of the powertrain system 42.

In some embodiments, the frame assembly 12 is coupled to one or more actuators, shown in FIG. 1 as leveling actuators 50. The lift device 10 includes four leveling actuators 50, one in each corner of the frame assembly 12. The leveling actuators 50 extend and retract vertically between a stored position and a deployed position. In the stored position, the leveling actuators 50 are raised and do not contact the ground. In the deployed position, the leveling actuators 50 contact the ground, lifting the frame assembly 12. The length of each of the leveling actuators 50 in their respective deployed positions may be varied to adjust the pitch (i.e., rotational position about the lateral axis 30) and the roll (i.e., rotational position about the longitudinal axis 32) of the frame assembly 12. Accordingly, the lengths of the leveling actuators 50 in their respective deployed positions may be adjusted such that the frame assembly 12 is leveled with respect to the direction of gravity, even on uneven or sloped terrains. The leveling actuators 50 may additionally lift the tractive elements of the tractive assemblies 40 off the ground, preventing inadvertent driving of the lift device 10.

Referring to FIG. 1, the lift assembly 14 includes a number of subassemblies, shown as scissor layers 60, each including a first member, shown as inner member 62, and a second member, shown as outer member 64. In each scissor layer 60, the outer member 64 receives the inner member 62. The inner member 62 is pivotally coupled to the outer member 64 near the centers of both the inner member 62 and the outer member 64. Accordingly, inner member 62 pivots relative to the outer member 64 about a lateral axis. The scissor layers 60 are stacked atop one another to form the lift assembly 14. Each inner member 62 and each outer member 64 has a top end and a bottom end. The bottom end of each inner member 62 is pivotally coupled to the top end of the outer member 64 immediately below it, and the bottom end of each outer member 64 is pivotally coupled to the top end of the inner member 62 immediately below it. Accordingly, each of the scissor layers 60 are coupled to one another such that movement of one scissor layer 60 causes a similar movement in all of the other scissor layers 60. The bottom ends of the inner member 62 and the outer member 64 belonging to the lowermost of the scissor layers 60 are coupled to the frame assembly 12. The top ends of the inner member 62 and the outer member 64 belonging to the uppermost of the scissor layers 60 are coupled to the platform 16. The inner members 62 and/or the outer members 64 are slidably coupled to the frame assembly 12 and the platform 16 to facilitate the movement of the lift assembly 14. Scissor layers 60 may be added to or removed from the lift assembly 14 to increase or decrease, respectively, the maximum height that the platform 16 is configured to reach.

One or more actuators (e.g., hydraulic cylinders, pneumatic cylinders, motor-driven leadscrews, etc.), shown as lift actuators 66, are configured to extend and retract the lift assembly 14. As shown in FIG. 1, the lift assembly 14 includes a pair of lift actuators 66. Lift actuators 66 are pivotally coupled to an inner member 62 at one end and pivotally coupled to another inner member 62 at the opposite end. These inner members 62 belong to a first scissor layer 60 and a second scissor layer 60 that are separated by a third scissor layer 60. In other embodiments, the lift assembly 14 includes more or fewer lift actuators 66 and/or the lift actuators 66 are otherwise arranged. The lift actuators 66 are configured to actuate the lift assembly 14 to selectively reposition the platform 16 between the lowered position, where the platform 16 is proximate the frame assembly 12, and the raised position, where the platform 16 is at an elevated height. In some embodiments, extension of the lift actuators 66 moves the platform 16 vertically upward (extending the lift assembly 14), and retraction of the linear actuators moves the platform 16 vertically downward (retracting the lift assembly 14). In other embodiments, extension of the lift actuators 66 retracts the lift assembly 14, and retraction of the lift actuators 66 extends the lift assembly 14. In some embodiments, the outer members 64 are approximately parallel and/or contacting one another when with the lift assembly 14 in a stored position. The lift device 10 may include various components to drive the lift actuators 66 (e.g., pumps, valves, compressors, motors, batteries, voltage regulators, etc.).

Referring again to FIG. 1, the platform 16 includes a support surface, shown as deck 70, defining a top surface configured to support operators and/or equipment and a bottom surface opposite the top surface. The bottom surface and/or the top surface extend in a substantially horizontal plane. A thickness of the deck 70 is defined between the top surface and the bottom surface. The bottom surface is coupled to a top end of the lift assembly 14. In some embodiments, the deck 70 is rectangular. In some embodiments, the deck 70 has a footprint that is substantially similar to that of the frame assembly 12.

Referring again to FIG. 1, a number of guards or railings, shown as guard rails 72, extend upwards from the deck 70. The guard rails 72 extend around an outer perimeter of the deck 70, partially or fully enclosing a supported area on the top surface of the deck 70 that is configured to support operators and/or equipment. The guard rails 72 provide a stable support for the operators to hold and facilitate containing the operators and equipment within the supported area. The guard rails 72 define one or more openings 74 through which the operators can access the deck 70. The opening 74 may be a space between two guard rails 72 along the perimeter of the deck 70, such that the guard rails 72 do not extend over the opening 74. Alternatively, the opening 74 may be defined in a guard rail 72 such that the guard rail 72 extends across the top of the opening 74. In some embodiments, the platform 16 includes a door 76 that selectively extends across the opening 74 to prevent movement through the opening 74. The door 76 may rotate (e.g., about a vertical axis, about a horizontal axis, etc.) or translate between a closed position, shown in FIG. 1, and an open position. In the closed position, the door 76 prevents movement through the opening 74. In the open position, the door 76 facilitates movement through the opening 74.

Referring again to the embodiments of FIG. 1, the platform 16 further includes one or more platforms, shown as extensions 78, that are received by the deck 70 and that each define a top surface. The extensions 78 are selectively slidable relative to the deck 70 between an extended position and a retracted position. In the retracted position, shown in FIG. 1, the extensions 78 are completely or almost completely received by the deck 70. In the extended position, the extensions 78 project outward (e.g., longitudinally, laterally, etc.) relative to the deck 70 such that their top surfaces are exposed. With the extensions 78 projected, the top surfaces of the extensions 78 and the top surface of the deck 70 are all configured to support operators and/or equipment, expanding the supported area. In some embodiments, the extensions 78 include guard rails partially or fully enclose the supported area. The extensions 78 facilitate accessing areas that are spaced outward from the frame assembly 12.

Referring to FIG. 1, the access assembly 20 is coupled to a longitudinal side of the frame assembly 12. As shown in FIG. 1, the access assembly 20 is a ladder assembly extending along a longitudinal side of the frame assembly 12. The access assembly 20 is aligned with the door 76 such that, when the platform 16 is in the lowered position, the access assembly 20 facilitates access to the upper surface of the platform 16 through the opening 74.

Figure 2A:
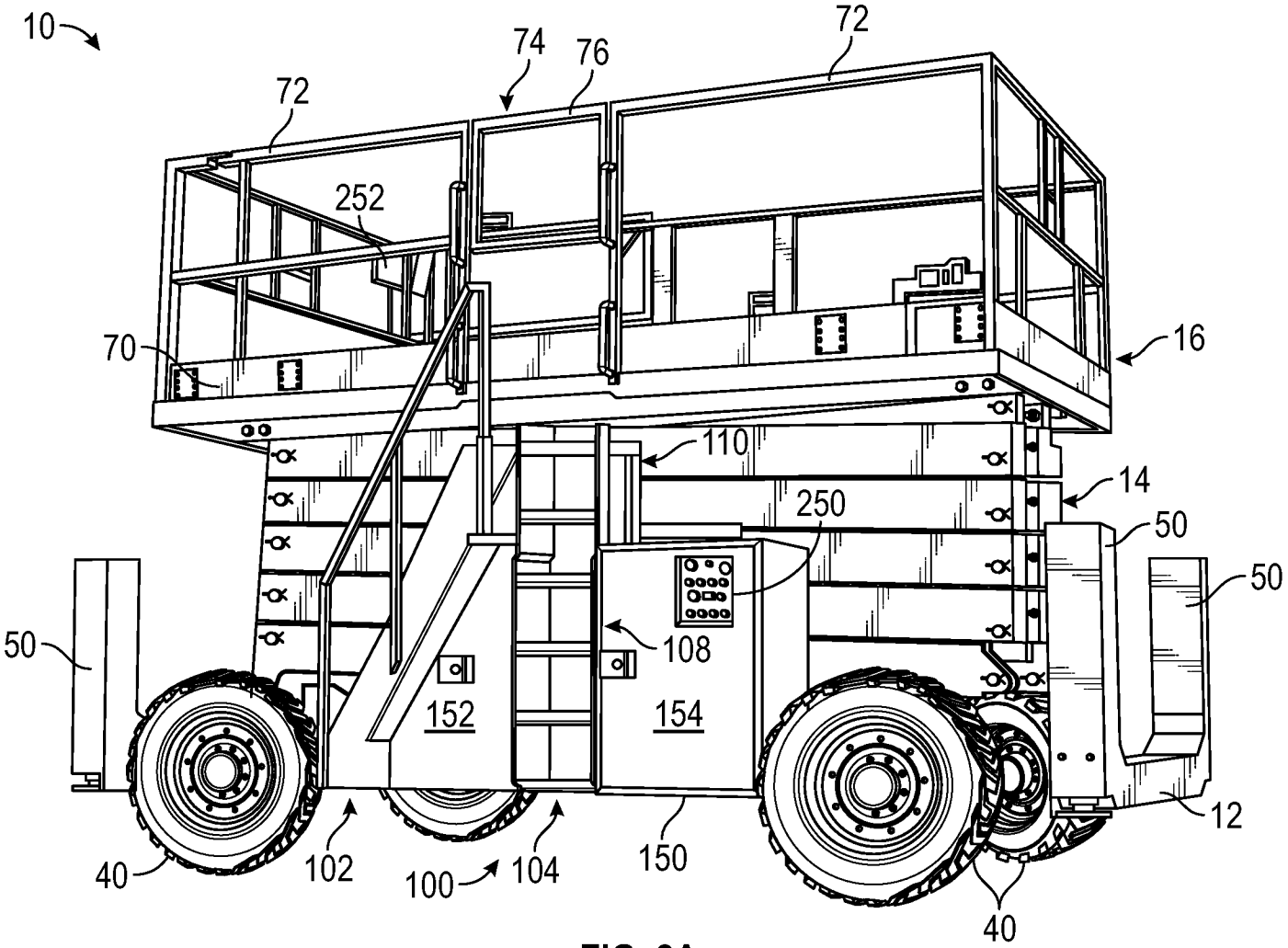
FIG. 2A is a perspective view of a lift device including an access assembly that includes a stair assembly in a stored position, according to an exemplary embodiment.
Figure 2B:
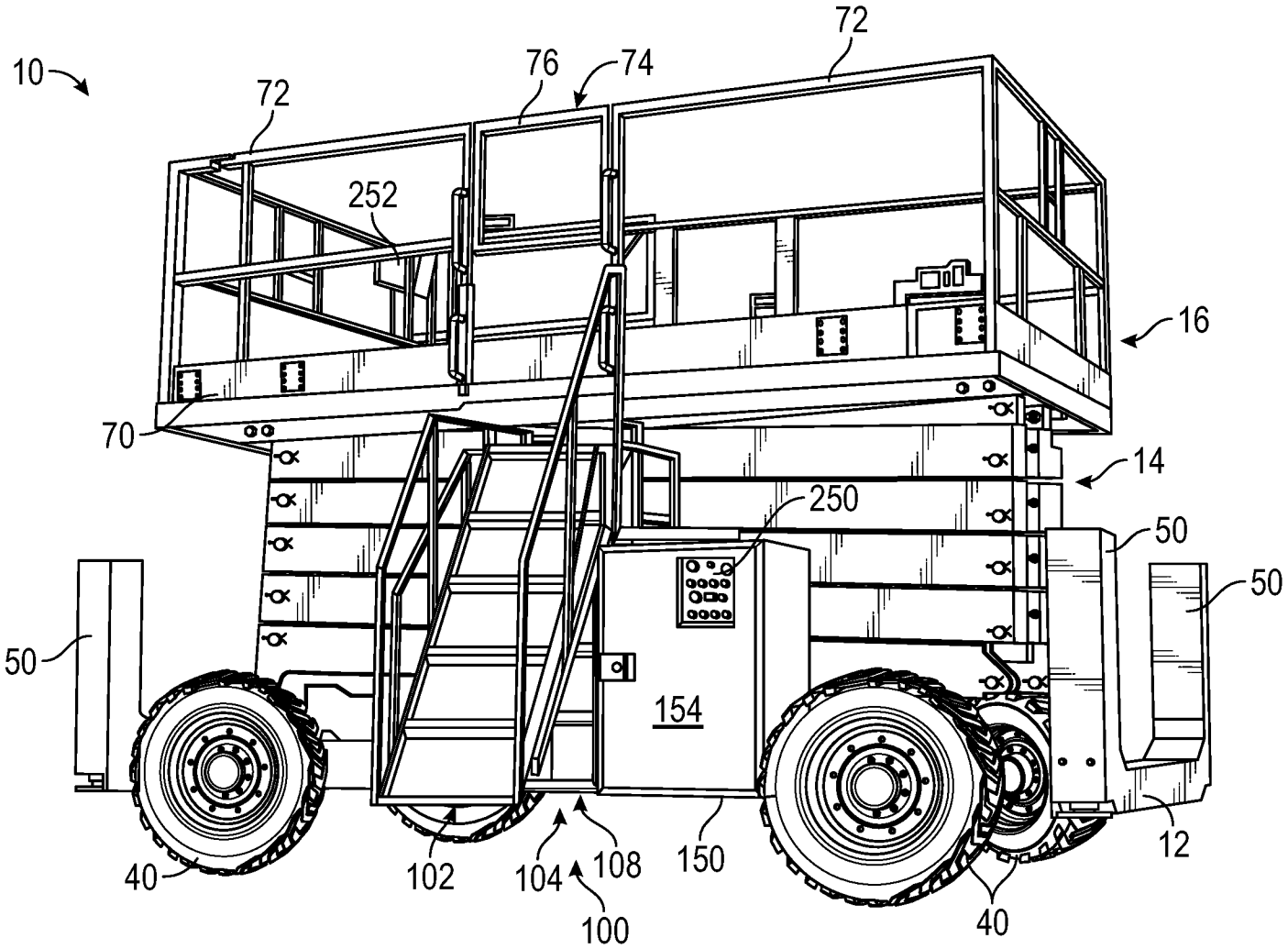
FIG. 2B is a perspective view of the lift device of FIG. 2A with the stair assembly in a deployed position.

Referring to FIGS. 2A-9C, the lift device 10 is shown according to another embodiment. The embodiment of the lift device 10 shown in FIGS. 2A-9C may be substantially similar to the lift device 10 shown in FIG. 1, except as otherwise stated. As shown in FIGS. 2A and 2B, the access assembly 20 is omitted and replaced with an assembly, shown as access assembly 100. The access assembly 100 is coupled to and disposed along a longitudinal side of the frame assembly 12 (i.e., a side parallel to the longitudinal axis 32). Placement of the access assembly 100 along a longitudinal side prevents obstruction of the access assembly by the extensions 78 in embodiments where the extensions 78 are configured to extend from a lateral side of the deck 70. The access assembly 100 is aligned with an opening 74 such that the access assembly 100 provides access to the top surface of the deck 70 from the ground through the opening 74.

Figure 3:
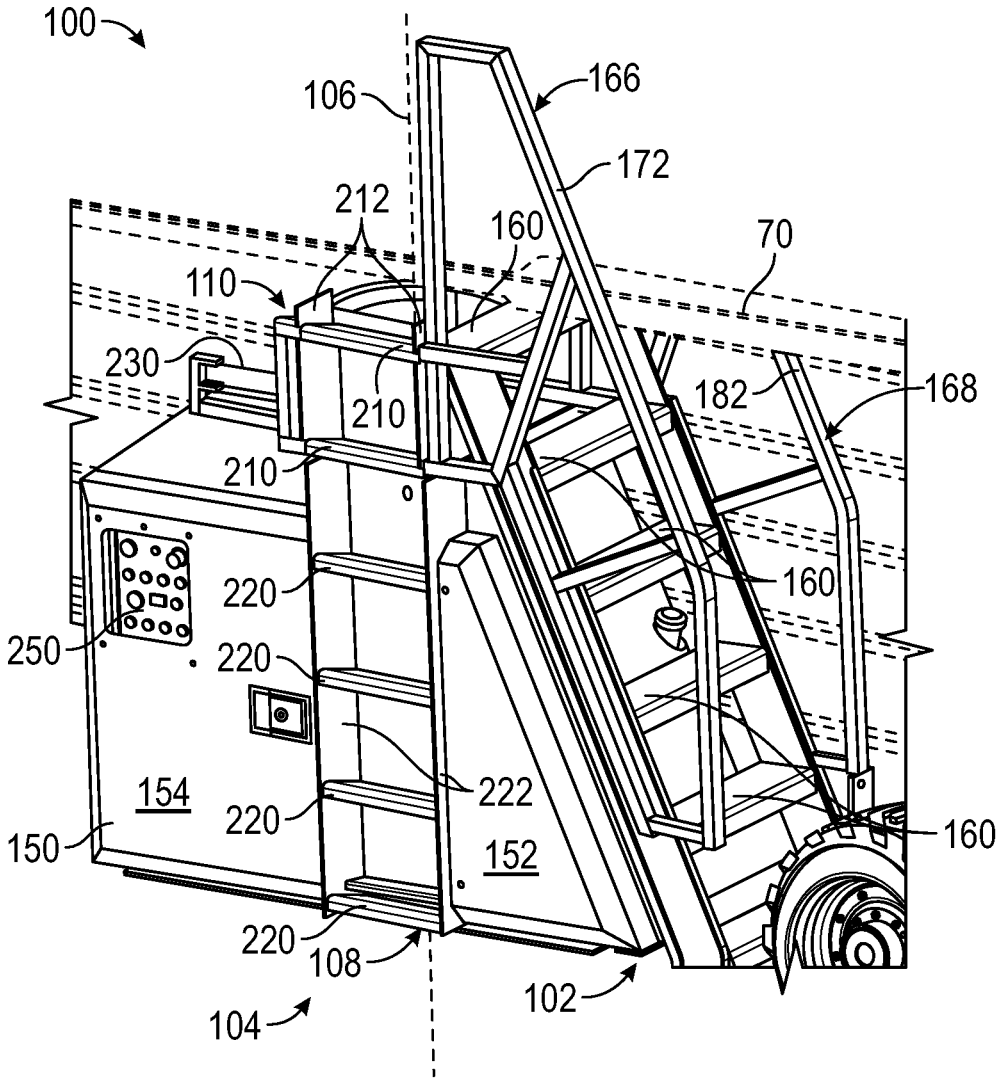
FIG. 3 is a another perspective view of the access assembly FIG. 2A with the stair assembly in the stored position, according to an exemplary embodiment.

Referring to FIG. 3, the access assembly 100 includes a first assembly, shown as stair assembly 102, and a second assembly, shown as ladder assembly 104. The stair assembly 102 and the ladder assembly 104 are each configured to selectively provide access to the top surface of the deck 70 through the opening 74. The stair assembly 102 is rotatably coupled to the frame assembly 12. The stair assembly 102 is rotatable relative to the frame assembly 12 about a vertical axis 106, shown in FIG. 3. The stair assembly 102 is rotatable between a stored position, shown in FIGS. 2A and 3, and a deployed position, shown in FIG. 2B. In the stored position, the stair assembly 102 is rotated toward (e.g., rested against, etc.) the frame assembly 12, and in the deployed position, the stair assembly 102 is rotated away from the frame assembly 12. The ladder assembly 104 includes a first portion, shown as fixed portion 108, and a second portion, shown as rotating portion 110. The fixed portion 108 is fixed relative to the frame assembly 12, and the rotating portion 110 is fixed relative to and moves with the stair assembly 102. The stair assembly 102 may or may not include certain components and/or features (e.g., tread spacing, rise, run, step sizing, step thickness, railing height, etc.) outlined in the various technical specifications governing the provision of "stairs" for construction equipment, vehicles, etc. (i.e., the stair assembly 102 may or may not satisfy certain requirements so as to be "stairs" from a technical perspective, etc.). In some instances, stair assembly 102 is an "inclined ladder" having various supports in the form of rungs.

Figure 4:
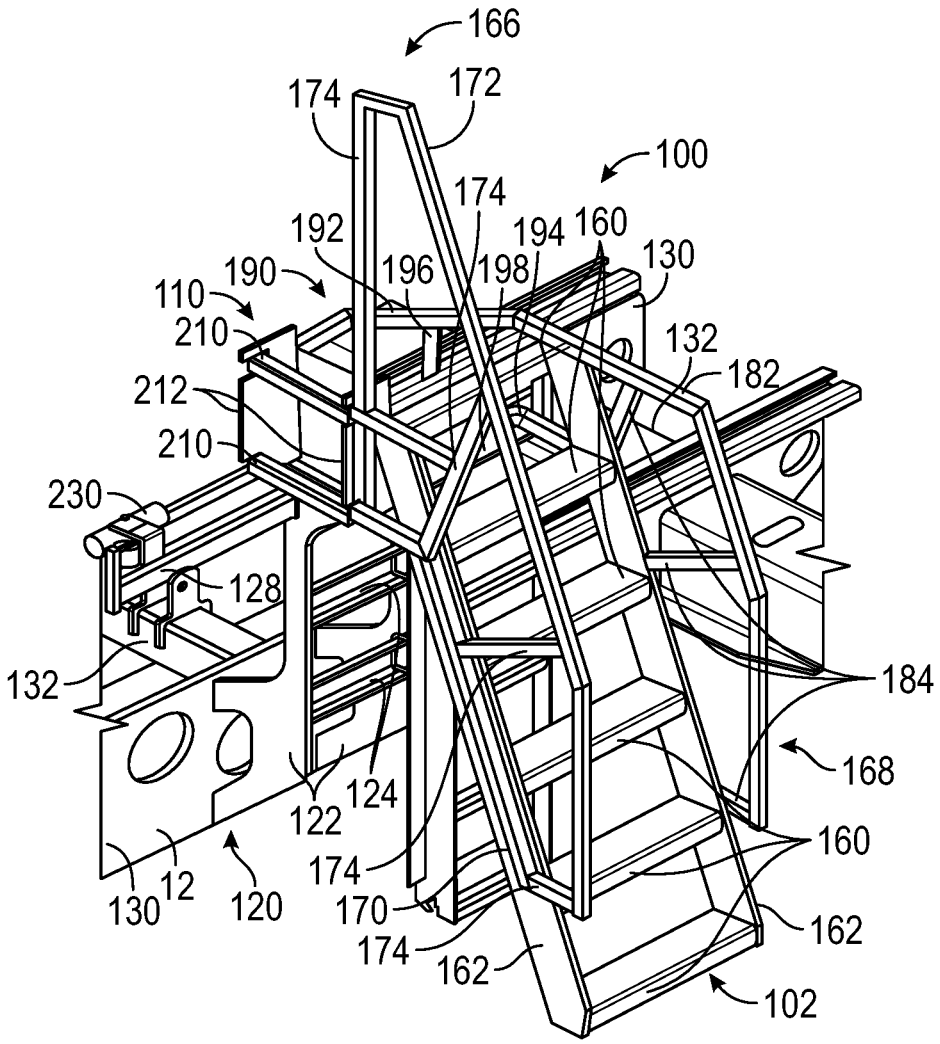
FIG. 4 is a perspective view of the access assembly of FIG. 2A with the stair assembly in the deployed position and with a number of components hidden.
Figure 5:
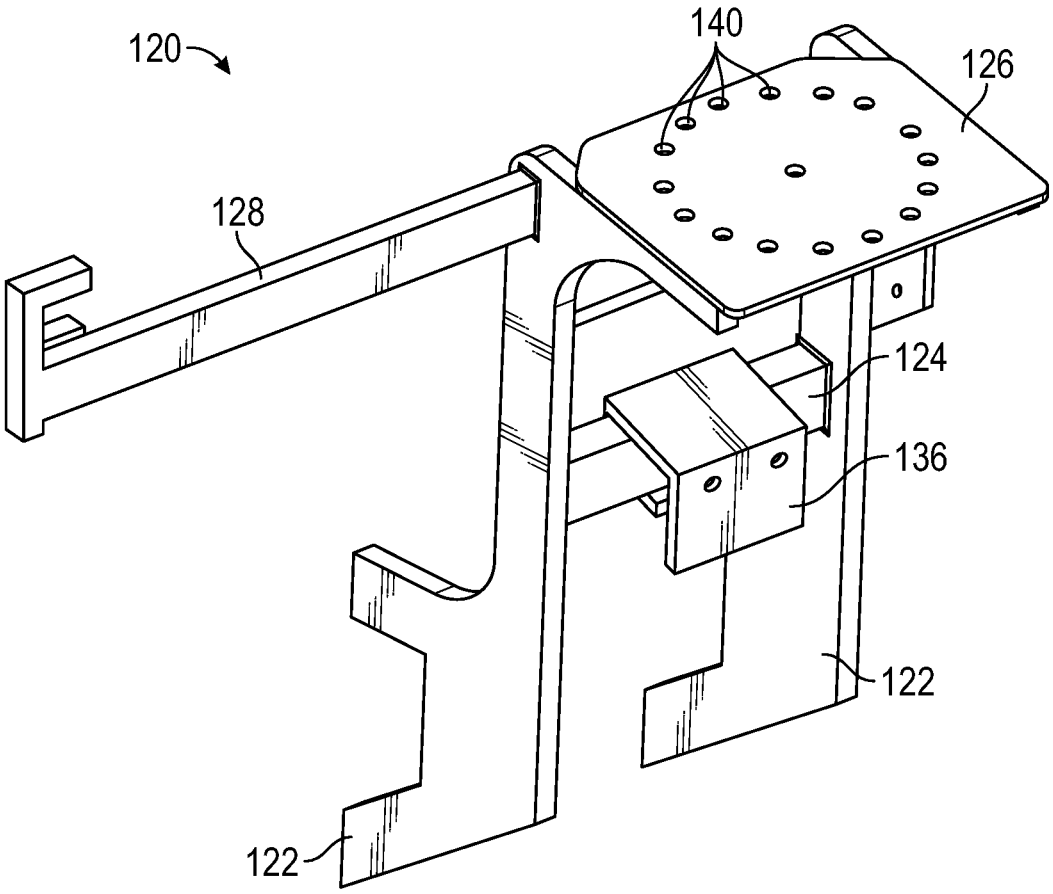
FIG. 5 is a perspective view of a subframe of the access assembly of FIG. 2A, according to an exemplary embodiment.

Referring to FIGS. 4 and 5, the access assembly 100 further includes a frame assembly, shown as subframe 120. The subframe 120 indirectly couples the stair assembly 102 and the ladder assembly 104 to the frame assembly 12. The subframe 120 includes a pair of supports, shown as vertical members 122, one or more reinforcements, shown as cross members 124, a plate, shown as top plate 126, and an arm, shown as actuator arm 128. As shown in FIG. 4, the frame assembly 12 includes a pair of longitudinally extending members, shown as longitudinal members 130, coupled to one another by a number of cross members, shown as cross members 132. The vertical members 122 are each coupled (e.g., welded) to an outside side of one of the longitudinal members 130, extending upward from the frame assembly 12. The cross members 124 extend between and couple the vertical members 122. A bracket, shown as angle bracket 136, extends between a cross member 124 and the fixed portion 108 of the ladder assembly 104. The fixed portion 108 is fixedly coupled (e.g., bolted, welded, etc.) to the angle bracket 136, which is in turn fixedly coupled to a cross member 124. The fixed portion 108 may additionally or alternatively be fixedly coupled to the top plate 126. The top plate 126 defines a top surface extending along a horizontal plane. The top plate 126 defines a number of apertures 140 that facilitate coupling (e.g., bolting) a rotational member, shown in FIG. 9B as bearing 142 (e.g., a slew bearing). The bearing 142 rotatably couples the stair assembly 102 to the subframe 120. The actuator arm 128 is coupled to and extends longitudinally from one of the vertical members 122. A distal end of the actuator arm 128 is configured to be pivotally coupled to a first end of an actuator (e.g., the stair actuator 230). In some embodiments, the vertical members 122, the cross members 124, the top plate 126, and the actuator arm 128, and the angle bracket 136 all form a single weldment.

Referring to FIG. 3, the subframe 120 is at least partially surrounded by an enclosure, shown as housing 150. The housing 150 is coupled to the frame assembly 12 and extends from a longitudinal side of the frame assembly 12. The housing 150 includes a first section 152 and a second section 154, each disposed on opposite sides of the fixed portion 108 of the ladder assembly 104. A top surface of the first section 152 may be angled relative to the horizontal plane to facilitate placement of the stair assembly 102 directly above the first section 152. The housing 150 may be used in addition to or instead of the housing 48. Accordingly, the housing 150 may contain one or more components of the powertrain system 42. The housing 150 may include one or more doors to facilitate access to components of the powertrain system 42.

Figure 6B:
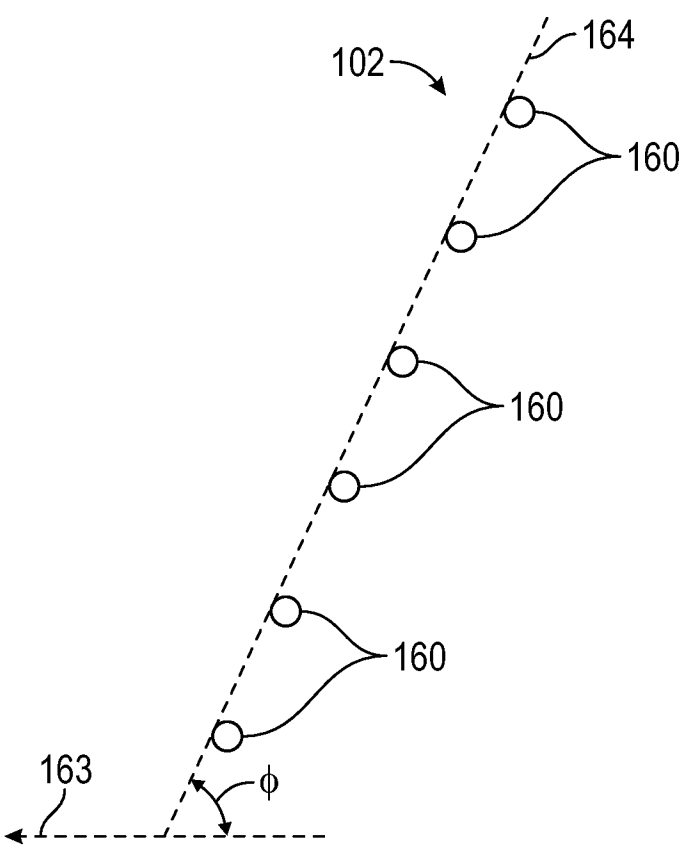
FIGS. 6A and 6B are side cross sectional views of the stair assembly of FIG. 2A, according to various exemplary embodiments.
Figure 6A:
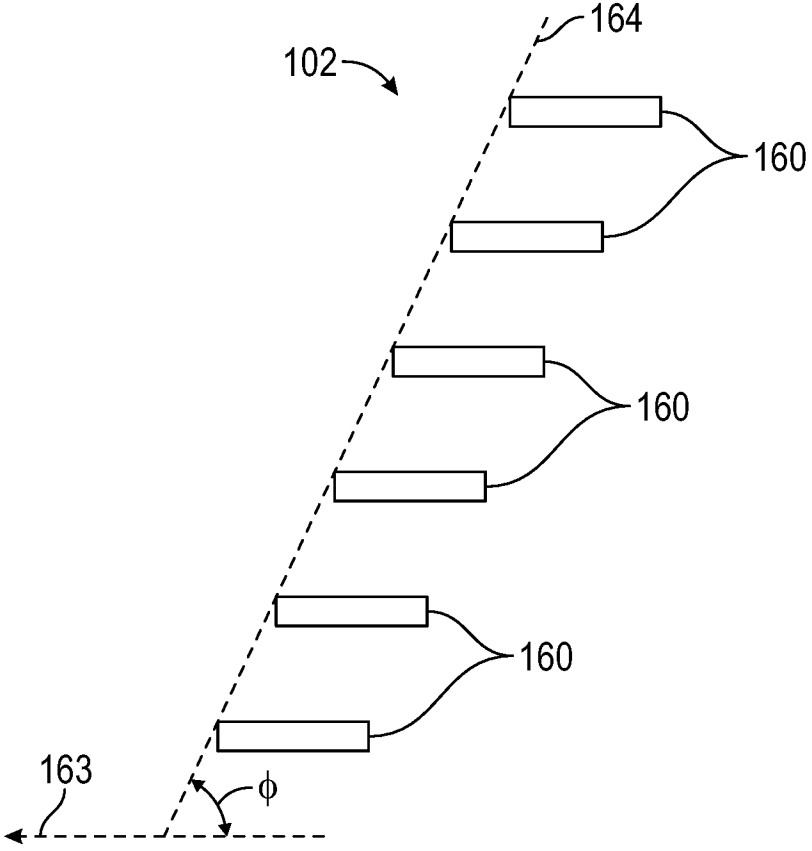

FIG. 4 shows the stair assembly 102, according to an exemplary embodiment. The stair assembly 102 includes a number of supports, shown as rungs or steps 160. As shown in FIG. 4, the stair assembly 102 includes six steps 160. In other embodiments, the stair assembly 102 includes more or fewer steps 160. The steps 160 are configured to support the feet of an operator ascending or descending the stair assembly 102. As shown in FIGS. 4 and 6A, each step 160 has a rectangular cross-sectional shape. In other embodiments, the steps 160 have a different cross-sectional shape, such as a rounded or a circular cross section. An example of steps 160 having a rounded cross section is shown in FIG. 6B. Each of the steps 160 extends widthwise between the side plates 162 and is fixedly coupled to side plates 162. Accordingly, the steps 160 extend parallel to one another. In some embodiments, the width of each step 160 is the same, such that the side plates 162 are parallel to one another.

Referring to FIGS. 6A and 6B, the steps 160 are arranged along an incline such that each step 160 is offset from the next step 160 both vertically and horizontally or in a depth direction. The stair assembly 102 faces in a direction 163 oriented perpendicular to the width of each step 160 and parallel to a horizontal plane. In use, the stair assembly 102 faces toward an operator using the stair assembly 102. Accordingly, each step 160 is offset from the step 160 above it in the direction 163. When the stair assembly 102 is in the stored position, the stair assembly 102 faces in a longitudinal direction. When the stair assembly 102 is in the deployed position, the stair assembly 102 faces in a lateral direction oriented outward from the frame assembly 12. An angle of incline $\phi$ of the steps 160 is measured as the angle between a plane 164 and a horizontal plane, as shown in FIGS. 6A and 6B. The plane 164 extends in the width direction of the steps 160 and intersects the point on each step 160 that is farthest outward in the direction 163. When multiple steps 160 follow the same incline, a single angle $\phi$ applies to all of the steps. If consecutive steps follow different inclines, the angle ϕ may be measured between pairs of consecutive steps 160 individually. In the embodiments shown herein, the steps 160 follow a single uniform incline. The steps 160 may have an angle ϕ between, but not including, 0 and 90 degrees. The dimensions of the steps (e.g., the width, thickness, depth, the angle ϕ, etc.) and other components of the stair assembly 102 may satisfy an accepted standard (e.g., EN ISO 2867).

Referring to FIG. 4, first railing assembly 166 and a second railing assembly 168 extend along opposing outer sides of the side plates 162. The first railing assembly 166 includes a support member 170, a hand rail or railing 172, and a number of connecting members 174. The second railing assembly 168 includes a support member 180, a hand rail or railing 182, and a number of connecting members 184. The support member 170 and the support member 180 are each fixedly coupled to a side plate 162. The railing 172 and the railing 182 are each offset above the steps 160 and the side plates 162. The connecting members 174 extend between and fixedly couple the support member 170 and the railing 172. The connecting members 184 extend between and fixedly couple the support member 180 and the railing 182. The railing 172 and the railing 182 provide support to an operator climbing or descending the stair assembly 102. In some embodiments, a portion of the railing 172 and/or the railing 182 extend parallel to the incline of the steps 160 at the angle ϕ.

Referring to FIG. 4, the stair assembly 102 further includes a base frame assembly 190 including an upper rail 192, a lower rail 194, a number of connecting rails 196, and a lower plate 198. The connecting rails 196 extend between and fixedly couple the upper rail 192 and the lower rail 194. The lower plate 198 extends across and couples to a bottom side of the lower rail 194. The base frame assembly 190 is coupled to the bearing 142, pivotally coupling the stair assembly 102 and the subframe 120. By way of example, the bearing 142 may be fastened (e.g., bolted) to the lower plate 198.

Figure 6D:
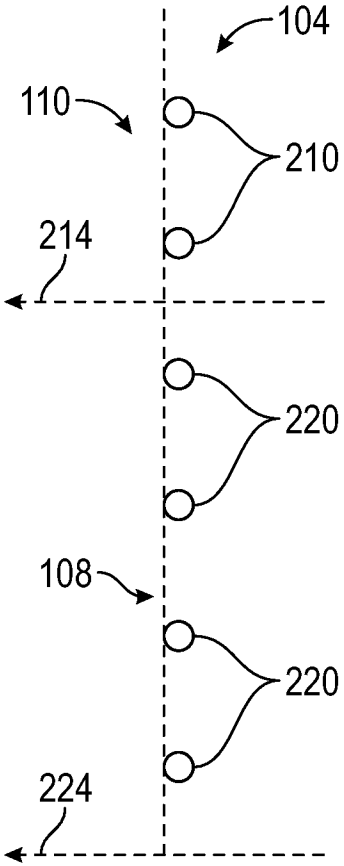
FIGS. 6C and 6D are side cross sectional views of a ladder assembly of the access assembly of FIG. 2A with the stair assembly in the stored position, according to various exemplary embodiments.
Figure 6C:
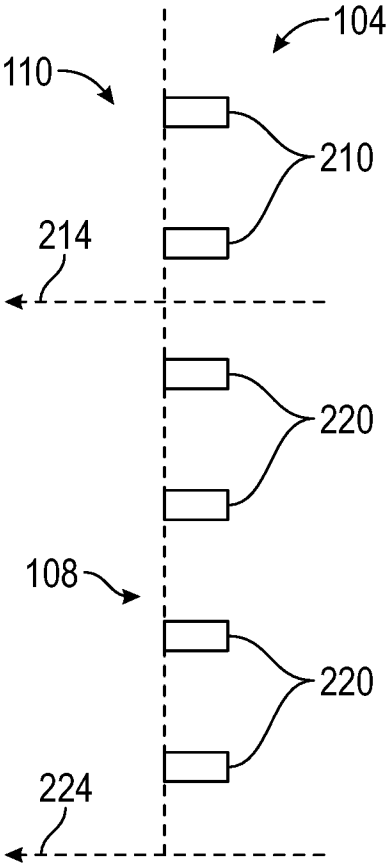

Referring to FIG. 4, the rotating portion 110 of the ladder assembly 104 is fixedly coupled to a side of the base frame assembly 190. The rotating portion 110 includes one or more supports, shown as steps or rungs 210. As shown in FIGS. 4 and 6C, the rungs 210 have a rectangular cross-sectional shape. In other embodiments, the rungs 210 have a round or otherwise shaped cross-sectional shape. An example of rungs 210 having a rounded cross section is shown in FIG. 6D. The rungs 210 are configured to support the feet and/or hands of an operator as the operator ascends or descends the ladder assembly 104. As shown in FIG. 4, the rungs 210 extend perpendicular to the steps 160 and parallel to one another. In some embodiments, the rungs 210 are aligned with and/or receive the upper rail 192 and/or the lower rail 194. The rungs 210 extend widthwise between and are fixedly coupled to a pair of side plates 212. In some embodiments, the rungs 210 are each the same width such that the side plates 212 extend parallel to one another. The rungs 210 may each be the same shape, the same size, the same orientation, and/or spaced apart evenly. In some embodiments, some or all of the components of the stair assembly 102 and the rotating portion 110 of the ladder assembly 104 form a single weldment and accordingly are fixed relative to one another.

Referring to FIGS. 6C and 6D, the rungs 210 are arranged vertically such that each rung 210 is offset from the next rung 210 vertically, but not horizontally or in a depth direction. The rotating portion 110 faces in a direction 214 oriented perpendicular to the width of each rung 210 and parallel to a horizontal plane. None of the rungs 210 are offset relative to one another in the direction 214. When the stair assembly 102 is in the stored position, the rotating portion 110 faces in a lateral direction oriented outward from the frame assembly 12. Accordingly, the rungs 210 are the same distance outward horizontally relative to the frame assembly 12. When the stair assembly 102 is in the deployed position, the rotating portion 110 faces in a longitudinal direction. Due to the vertical arrangement of the rungs 210, the rotating portion 110 has an angle of incline equal to 90 degrees. The dimensions of the rungs 210 (e.g., the width, thickness, depth, etc.) and other components of the ladder assembly 104 may satisfy an accepted standard (e.g., EN ISO 2867).

Referring to FIGS. 3 and 4, the fixed portion 108 of the ladder assembly 104 is fixedly coupled to the subframe 120, and by extension, to the frame assembly 12. The fixed portion 108 includes one or more supports, shown as steps or rungs 220. As shown in FIGS. 3 and 6C, the rungs 220 have a rectangular cross-sectional shape. In other embodiments, the rungs 220 have a round or otherwise shaped cross-sectional shape. An example of rungs 220 having a rounded cross section is shown in FIG. 6D. The rungs 210 are configured to support the feet and/or hands of an operator as the operator ascends or descends the ladder assembly 104. As shown in FIG. 4, the rungs 220 extend parallel to the longitudinal members 130 and to one another. When the stair assembly 102 is in the stored position, the rungs 220 extend parallel to the rungs 210. The rungs 220 extend widthwise between and are fixedly coupled to a pair of side plates 222. In some embodiments, the rungs 220 are each the same width such that the side plates 222 extend parallel to one another. The rungs 220 may each be the same shape, the same size, the same orientation, and/or spaced apart evenly. In some embodiments, the rungs 210 and the rungs 220 are each the same shape, the same size, the same orientation, and/or spaced apart evenly. In some embodiments, some or all of the components of the fixed portion 108 form a single weldment and accordingly are fixed relative to one another.

Referring to FIGS. 6C and 6D, the rungs 220 are arranged vertically such that each rung 220 is offset from the next rung 220 vertically, but not horizontally. The fixed portion 108 faces in a direction 224 oriented perpendicular to the width of each rung 220 and parallel to a horizontal plane. None of the rungs 220 are offset relative to one another in the direction 224. The fixed portion 108 faces in a lateral direction oriented outward from the frame assembly 12 regardless of the position of the stair assembly 102. Accordingly, the rungs 220 are the same distance outward horizontally relative to the frame assembly 12. In some embodiments, the fixed portion 108 and the rotating portion 110 are aligned such that the rungs 210 and the rungs 220 are the same distance outward horizontally relative to the frame assembly 12 when the stair assembly 102 is in the stored position. A pair of such embodiments are shown in FIGS. 6C and 6D. Due to the vertical arrangement of the rungs 220, the fixed portion 108 has an angle of incline equal to 90 degrees.

Referring to FIG. 4, the access assembly 100 includes an actuator, shown as stair actuator 230, that is configured to rotate the stair assembly 102 between the stored position and the deployed position. The stair actuator 230 may be any type of actuator including a lead screw driven by an electric motor, a hydraulic cylinder (e.g., powered by the pump 46), a pneumatic cylinder, a rotary actuator, or another type of actuator. In one embodiment, the stair actuator 230 is pivotally coupled to the distal end of the actuator arm 128 at one end and to the stair assembly 102 at the opposite end. Upon extension of the stair actuator 230, the stair assembly 102 moves to the deployed position. Upon retraction of the stair actuator 230, the stair assembly 102 moves to the stored position. In some embodiments, the stair actuator 230 is configured to receive energy from an energy storage device such that the stair actuator 230 is actuatable without an input from the primary driver 44. In other embodiments, the stair actuator 230 is omitted, and the stair assembly 102 is moved manually.

Figure 7:
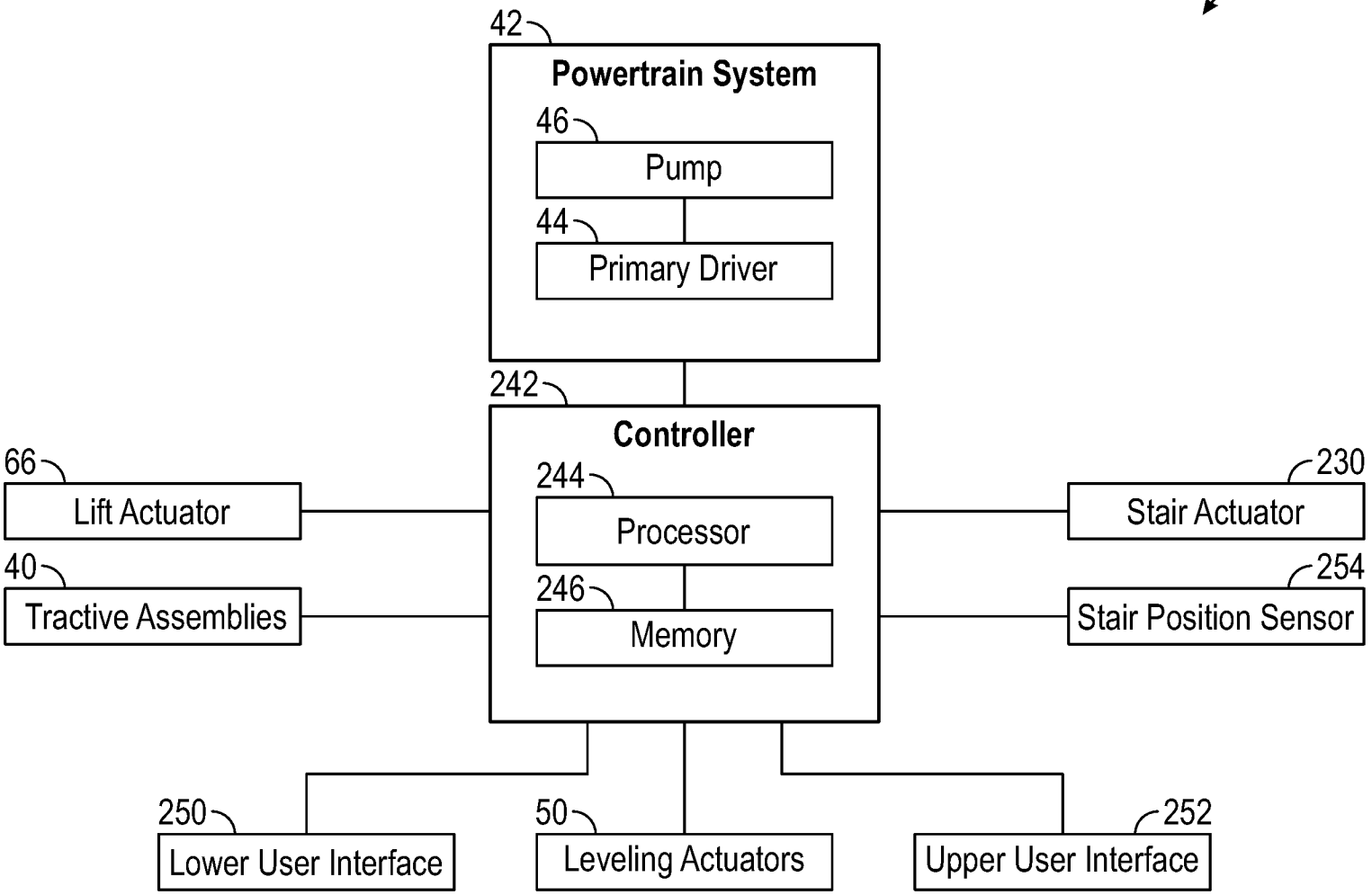
FIG. 7 is a block diagram of a control system of the lift device of FIG. 2A, according to an exemplary embodiment.

Referring to FIG. 7, the lift device 10 includes a control system 240 configured to control the operation of the lift device 10. The control system 240 may selectively prevent operation of the access assembly (e.g., with an interlock, etc.). The control system 240 includes a controller 242 including a processor 244 and a memory 246. The processor 244 is configured to issue commands to and process information from other components. The processor 244 may be implemented as a specific purpose processor, an application specific integrated circuit (ASIC), one or more field programmable gate arrays (FPGAs), a group of processing components, or other suitable electronic processing components. The memory 246 is one or more devices (e.g., RAM, ROM, flash memory, hard disk storage) for storing data and computer code for completing and facilitating the various user or client processes, layers, and modules described in the present disclosure. The memory 246 may be or include volatile memory or non-volatile memory and may include database components, object code components, script components, or any other type of information structure for supporting the various activities and information structures of the inventive concepts disclosed herein. The memory 246 is communicably connected to the processor 244 and includes computer code or instruction modules for executing one or more processes described herein.

The controller 242 is configured to control the tractive assemblies 40, the powertrain system 42, the leveling actuators 50, the lift actuators 66, and the stair actuator 230. The powertrain system 42 may be configured to supply power to the tractive assemblies 40, the lift actuator 66, and/or the stair actuator 230 (e.g., using the pump 46). Accordingly, the control system 240 may include clutches, valves, or other components through which the controller 242 can control the transfer of power to the various actuators and tractive elements.

In some embodiments, the control system 240 includes a first user interface or operator interface, shown as lower user interface 250, and a second user interface or operator interface, shown as upper user interface 252. The lower user interface 250 and the upper user interface 252 are operatively coupled to the controller 242. The lower user interface 250 and the upper user interface 252 are configured to facilitate control of the lift device 10 by an operator and to facilitate communication of information from the controller 242 to the operator. Referring to FIG. 3, the lower user interface 250 is coupled to the second section 154 of the housing 150. The lower user interface 250 and the upper user interface 252 may include joysticks, buttons, sliders, switches, touchscreens, displays, or other components to facilitate an interface between an operator and the controller 242. The lower user interface 250 and the upper user interface 252 may be used by an operator to control the movement of the tractive assemblies 40, the leveling actuators 50, the lift assembly 14 (e.g., through the lift actuators 66), and the stair assembly 102 (e.g., through the stair actuator 230). The control system 240 may include still another user interface or operator interface that is operatively coupled to the controller 242 and configured to facilitate control of (e.g., selectively repositioning, etc.) the stair assembly 102. The additional user interface or operator interface may be positioned to improve visibility of the stair assembly (e.g., coupled to one of the guard rails 72 adjacent and/or near the opening 74, etc.). The lower user interface 250 and/or the upper user interface 252 may be used by the operator to control driving and steering the tractive assemblies 40, operation of the stair assembly 102, and/or other vehicle functionalities. Referring to FIG. 2A, the upper user interface 252 is coupled to one of the guard rails 72 near a lateral side of the frame assembly 12. Alternatively, the upper user interface 252 may be coupled to one of the guard rails 72 near the opening 74. The lift device 10 may include multiple lower user interfaces 250 or multiple upper user interfaces 250. Incorporating both the lower user interface 250 and the upper user interface 252 facilitates control of the lift device 10 by an operator from the ground and/or from the platform 16.

Referring to FIG. 7, the control system 240 includes a sensor, shown as stair position sensor 254. In some embodiments, the stair position sensor 254 is configured to detect (e.g., provide sensing signals to the controller 242 for determining whether, etc.) the position or orientation of the stair assembly 102 relative to the frame assembly 12. By way of example, the stair position sensor 254 may be or include a rotary potentiometer. In other embodiments, the stair position sensor 254 is configured to detect whether (e.g., provide sensing signals to the controller 242 for determining whether, etc.) the stair assembly 102 is in one or more discrete positions or orientations (e.g., the stored position, the deployed position, etc.). In some embodiments, such as the embodiment shown in FIG. 8, the stair position sensor 254 is a limit switch that is closed when the stair assembly 102 is in the stored position. In some embodiments, the controller 242 is configured to prevent movement of the tractive assemblies 40 (i.e., driving) and/or movement of the lift assembly 14 when the stair assembly 102 is in a position other than the stored position.

Figure 8:
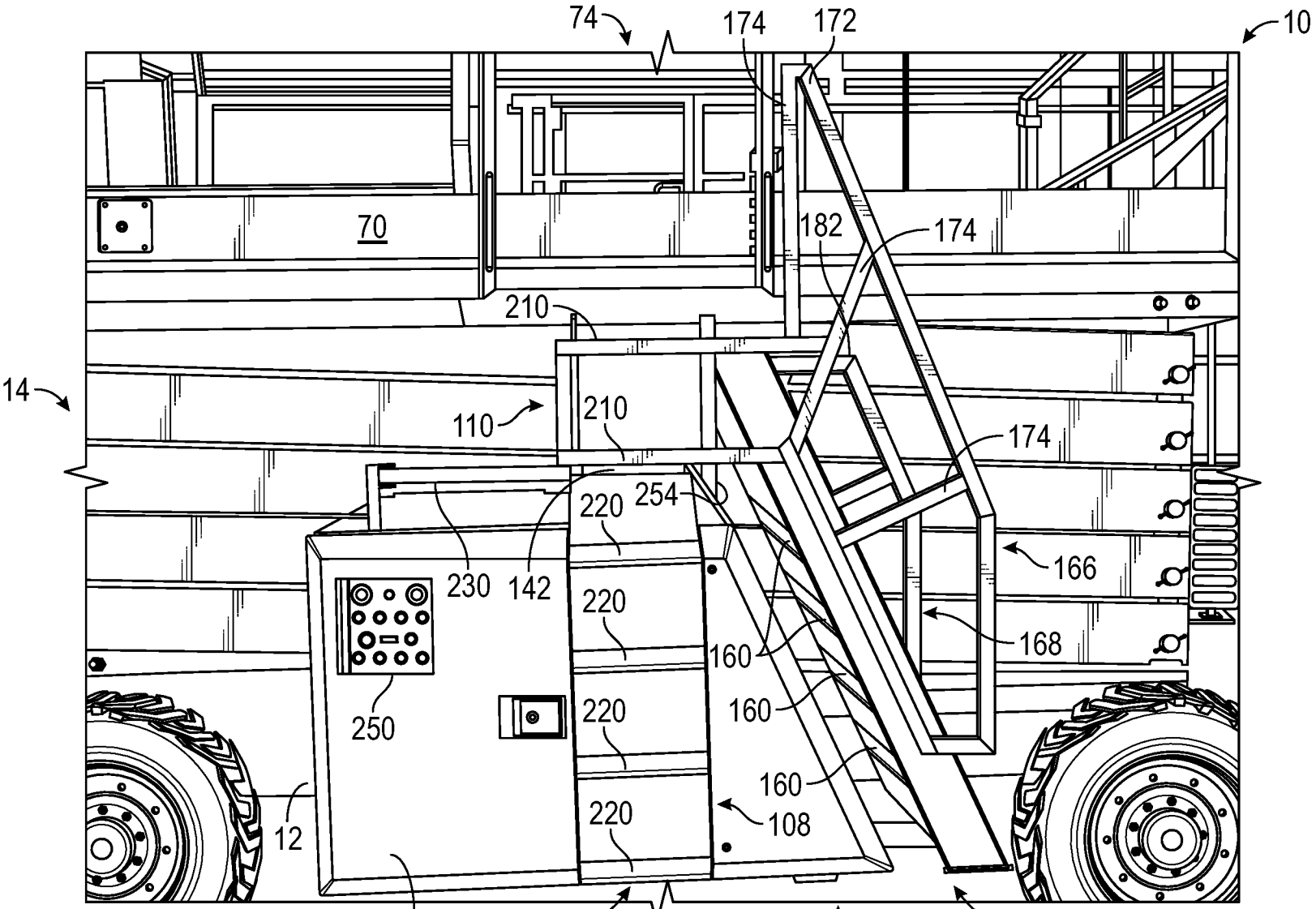
FIG. 8 is a front view of the access assembly of FIG. 2A with the stair assembly in the stored position.

In FIGS. 2A, 3, and 8, the stair assembly 102 is shown in the stored position. In this configuration, the steps 160 of the stair assembly 102 extend at least partially directly beneath the working area of the platform 16. This reduces the overall size of the lift device 10. In the stored position, the steps 160 extend widthwise parallel to the lateral direction. The railing 182 and all of the other components of the second railing assembly 168 may be arranged such that they do not extend above the bottom surface of the deck 70. This facilitates the stair assembly 102 extending directly beneath the deck 70 in the stored position. In some embodiments, the second railing assembly 168 is disposed entirely below a top surface of the uppermost of the steps 160. In the stored position, the first railing assembly 166 is not disposed directly beneath the deck 70. Rather, the first railing assembly 166 is disposed laterally outward from the deck 70. One of the connecting members 174 and the railing 172 extend above the top surface of the deck 70, providing a hand hold to support the operator while the operator transitions from the stair assembly 102 to the deck 70. While in the stored position, this connecting member 174 and the railing 172 are longitudinally offset from the opening 74 such that the first railing assembly 166 does not interfere with the operator accessing the opening 74 using the ladder assembly 104.

Referring again to FIGS. 2A, 3, and 8, with the stair assembly 102 in the stored position, the fixed portion 108 and the rotating portion 110 of the ladder assembly 104 both face in the same direction, laterally outward from the frame assembly 12. The fixed portion 108 and the rotating portion 110 are aligned such that each of the rungs 210 and the rungs 220 are disposed directly above or directly beneath one another. The rungs 210 and the rungs 220 extend parallel to the longitudinal direction. The rungs 210 and the rungs 220 are the same lateral distance from the frame assembly 12. In some embodiments, one or more of the rungs 210 and the rungs 220 at least partially extend directly beneath the deck 70. With the stair assembly 102 in the stored position, the ladder assembly 104 is unobstructed, and the ladder assembly 104 facilitates access to the deck 70 from the ground through the opening 74.

Figure 9A:
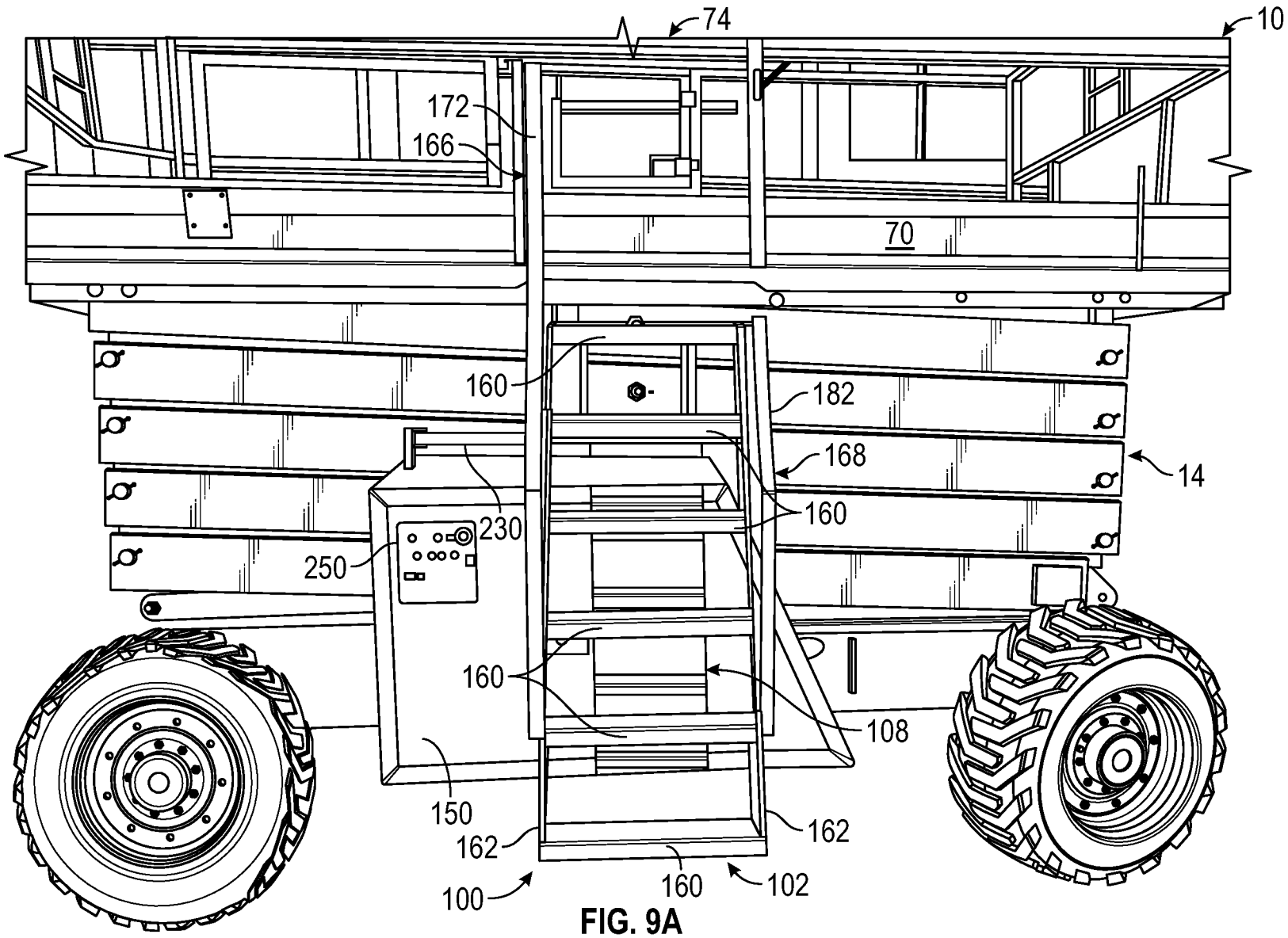
FIGS. 9A-9C are various views of the access assembly of FIG. 2A with the stair assembly in the deployed position.
Figure 9B:
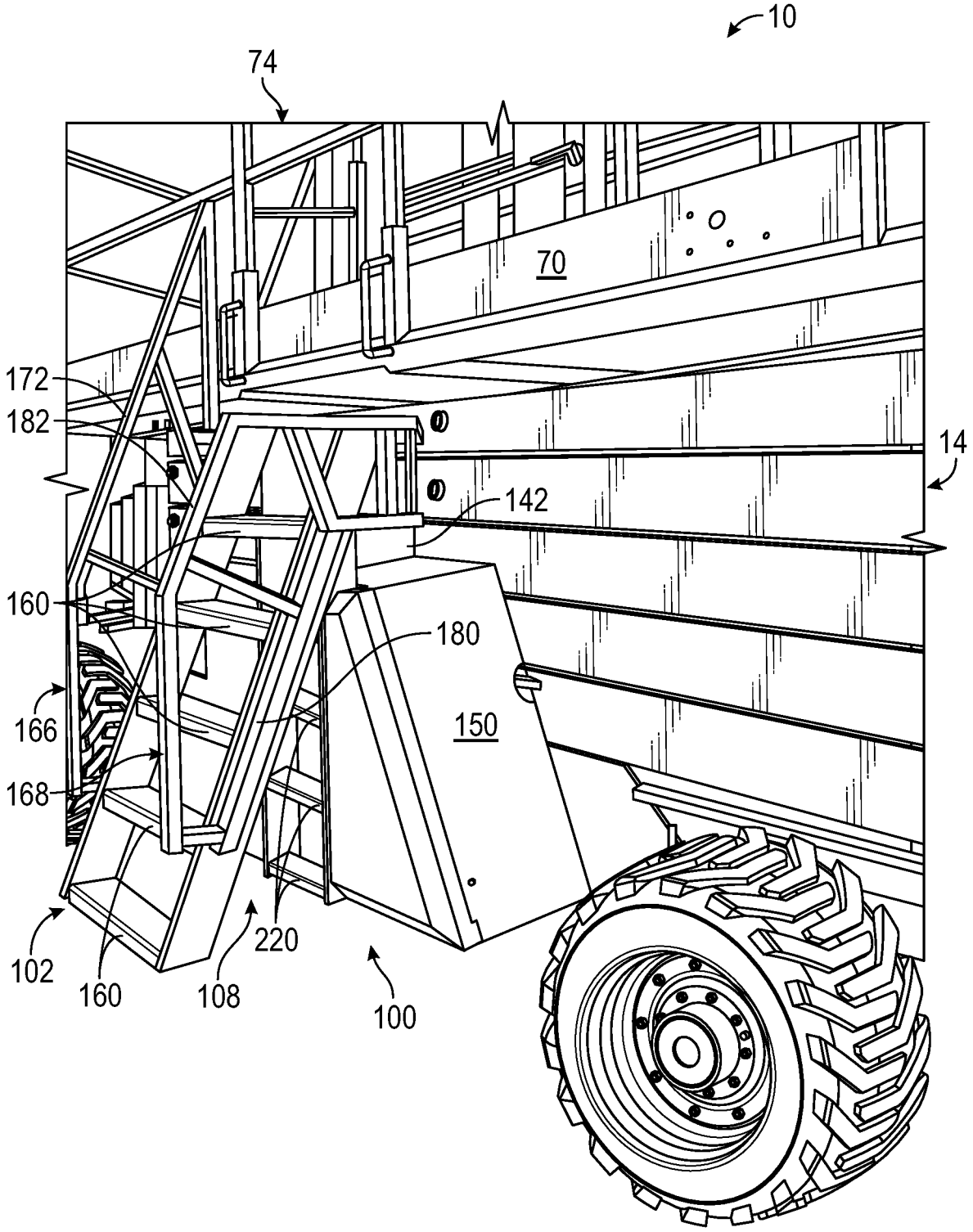
Figure 9C:
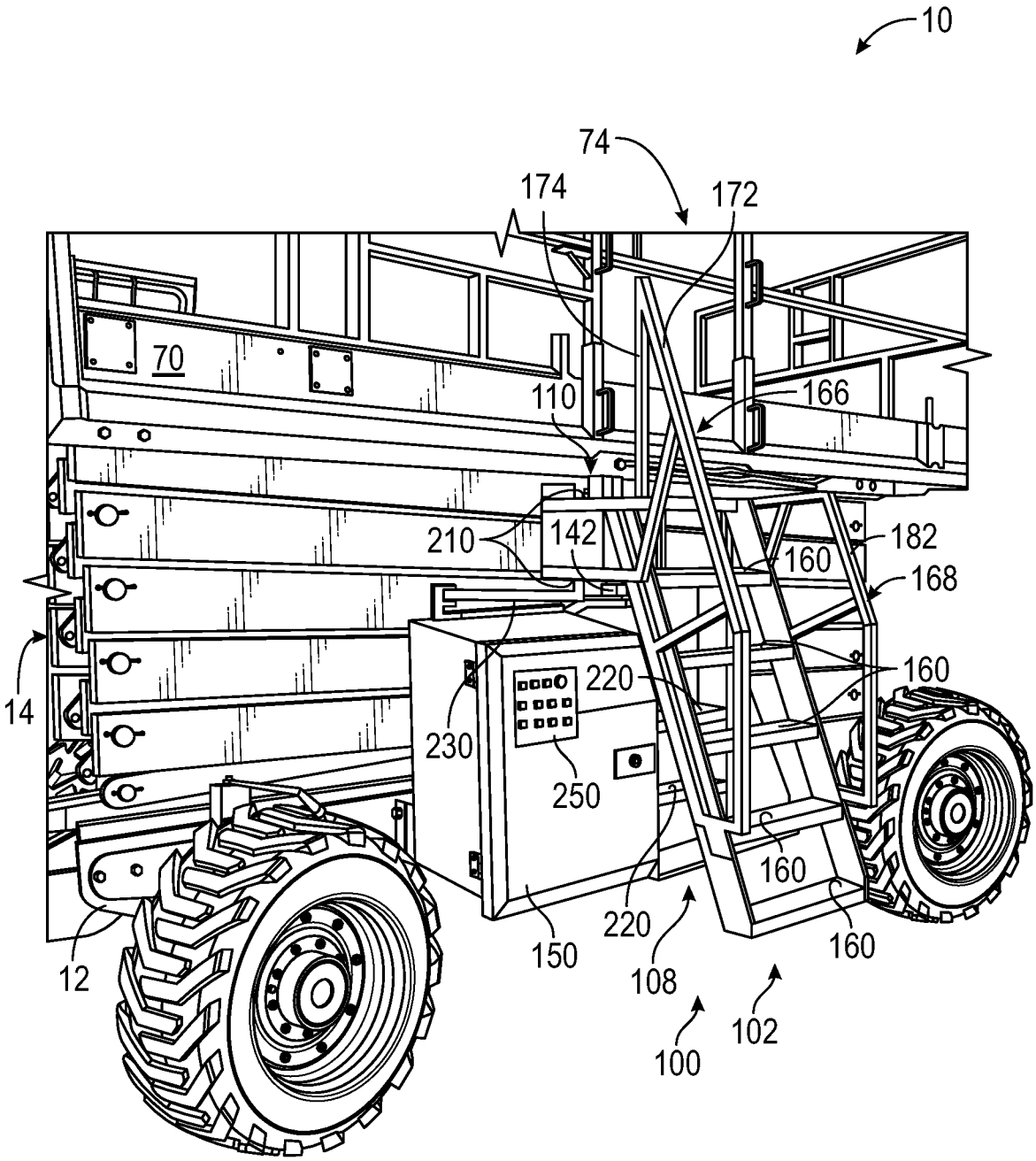

Referring to FIGS. 2B, 4, and 9A-9C, the stair assembly 102 is shown in the deployed position. In some embodiments, the stair assembly 102 rotates approximately 90 degrees between the stored and deployed positions. In the deployed position, the stair assembly 102 is rotated outward from the frame assembly 12, expanding the overall size of the lift device 10. In some embodiments, only the uppermost of the steps 160 extends directly beneath the deck 70. In other embodiments, none of the steps 160 extend directly beneath the deck 70. Accordingly, the steps 160 extend farther outward laterally relative to the chassis when the stair assembly 102 is in the deployed position than when the stair assembly 102 is in the stored position. The steps 160 extend parallel to the longitudinal direction. In the deployed position, the stair assembly 102 faces laterally outward from the frame assembly 12. The bottommost of the steps 160 extends farthest laterally outward from the frame assembly 12. Each consecutive step 160 is disposed above and extends a lesser distance laterally outward from the frame assembly 12. Accordingly, the uppermost of the steps 160 extends the least distance laterally outward from the frame assembly 12. The relative spacing and orientation of the steps 160 is constant between the stored and deployed positions, however, the stair assembly 102 faces in a longitudinal direction when in the stored position. As shown in FIG. 9A, the first railing assembly 166 and the second railing assembly 168 extend adjacent opposing vertical sides of the opening 74 when the stair assembly 102 is in the deployed position.

Referring again to FIGS. 2B, 4, and 9A-9C, with the stair assembly 102 in the deployed position, the fixed portion 108 and the rotating portion 110 face in different directions. As the stair assembly 102 rotates to the deployed position, the rotating portion 110 rotates away from the fixed portion 108 and toward the frame assembly 12. In the deployed position, the fixed portion 108 faces laterally outward from the frame assembly, and the rotating portion 110 faces in the longitudinal direction. Accordingly, the rungs 210 are parallel to the lateral direction, and the rungs 220 are parallel to the longitudinal direction. The fixed portion 108 remains aligned with the opening 74, however the stair assembly 102 extends directly laterally outward from the fixed portion 108. The rungs 220 are then disposed between the stair assembly 102 and the frame assembly 12, obstructing access by an operator to the fixed portion 108. Accordingly, with the stair assembly 102 in the deployed position, the ladder assembly 104 does not provide access from the ground to the deck 70.

Figure 10:
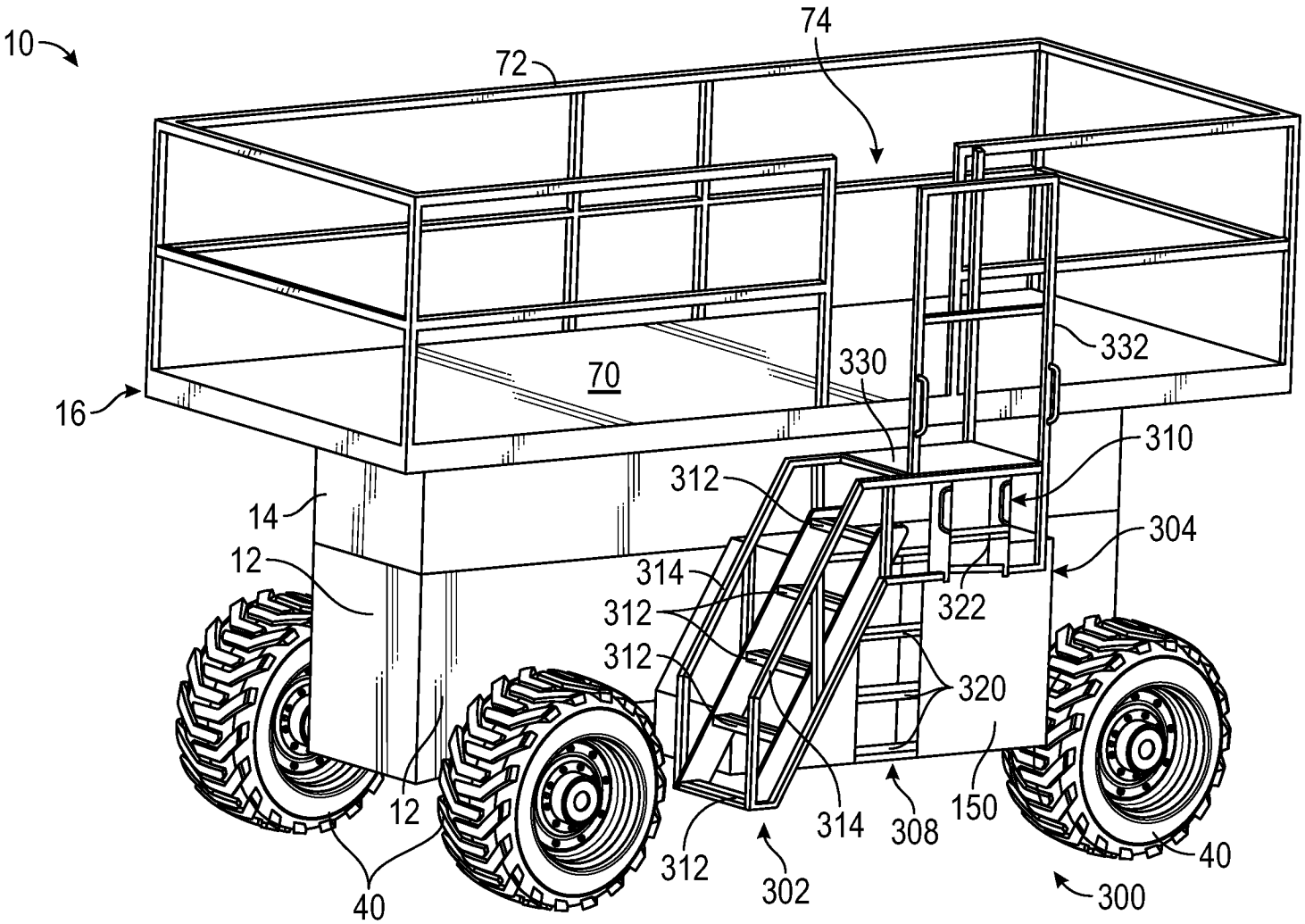
FIG. 10 is a perspective view of a lift device including an access assembly, according to another exemplary embodiment.

FIG. 10 shows the lift device 10, according to an alternative embodiment, including an access assembly 300. The lift device 10 and the access assembly 300 shown in FIG. 10 may be substantially similar to the lift device 10 and the access assembly 100 shown in FIGS. 2A-9C, except as otherwise stated. The access assembly 300 includes a stair assembly 302 and a ladder assembly 304 including a fixed portion 308 and a translating portion 310. The stair assembly 302 includes a number of steps 312 and a pair of railings 314, the fixed portion 308 includes a number of rungs 320, and the translating portion includes one or more rungs 322. The stair assembly 302 further includes a platform 330 and a guard rail 332 extending upward therefrom. The steps 312, the railings 314, the rungs 322, the platform 330, and the guard rail 332 are all fixed relative to the stair assembly 302. The rungs 320 are fixed relative to the frame assembly 12. The stair assembly 302 faces in a longitudinal direction, and the fixed portion 308 and the translating portion 310 of the ladder assembly 304 face in a lateral direction extending away from the frame assembly 12. With the stair assembly 302 in a stored position, the steps 312 and the platform 330 at least partially extend directly beneath the deck 70, and the ladder assembly 304 can be used to access the top surface of the deck 70 from the ground through an opening in the guard rail 332. When the stair assembly 302 moves to a deployed position, the stair assembly 302 translates laterally outwards, exposing the steps 312 and the platform 330 such that the stair assembly 302 facilitates access to the top surface of the deck 70 from the ground. With the stair assembly 302 in the deployed position, the translating portion 310 is laterally offset from the fixed portion 308, preventing access to the top surface of the deck 70 using the ladder assembly 304.

Figure 11A:
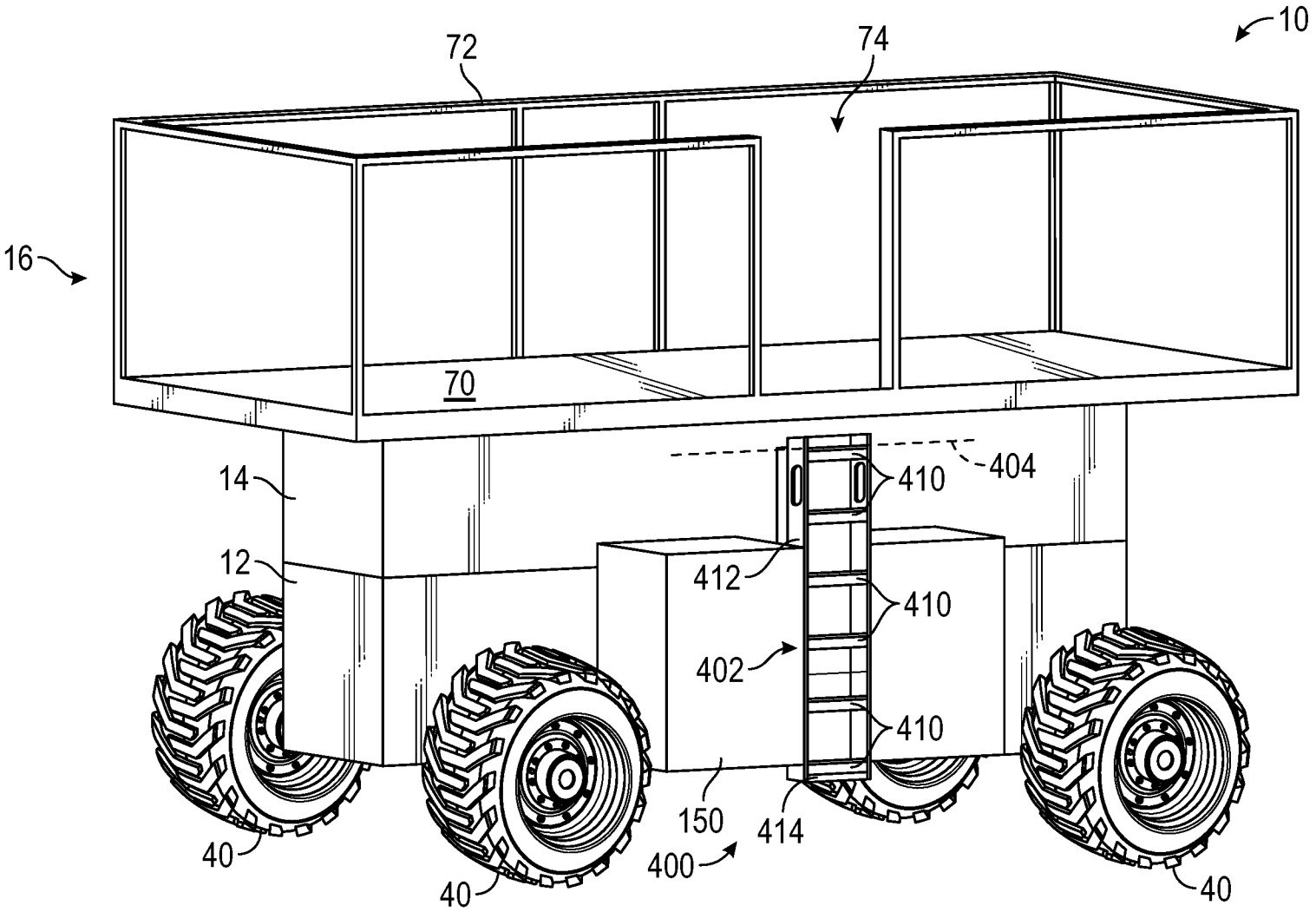
FIG. 11A is a perspective view of a lift device including an access assembly that includes a stair assembly in a stored position, according to an exemplary embodiment.
Figure 11B:
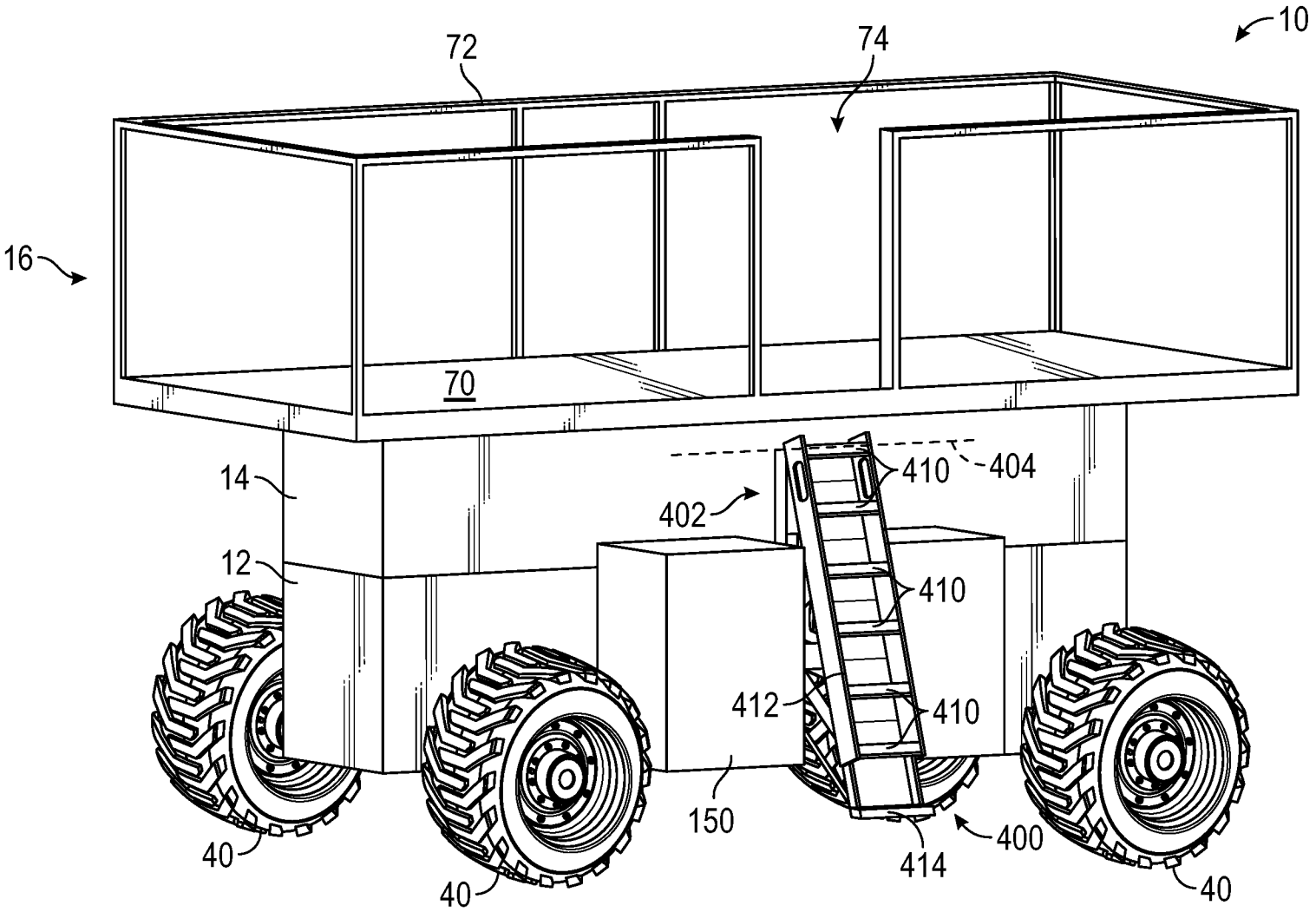
FIG. 11B is a perspective view of the lift device of FIG. 11A with the stair assembly in a deployed position.

FIGS. 11A and 11B show the lift device 10, according to an alternative embodiment, including an access assembly 400. The lift device 10 and the access assembly 400 shown in FIGS. 11A and 11B may be substantially similar to the lift device 10 and the access assembly 100 shown in FIGS. 2A-9C, except as otherwise stated. The access assembly 400 includes a stair assembly 402 that is pivotable about a horizontal axis 404 relative to the frame assembly 12. The stair assembly 402 includes a number of rungs or steps 410 fixedly coupled to a body 412. A bottom rung or bottom step 414 is translatable relative to the body 412 between a retracted position, shown in FIG. 11A, and an extended position, shown in FIG. 11B. The stair assembly 402 faces in a lateral direction extending away from the frame assembly 12. The stair assembly 402 is pivotable about the horizontal axis 404 between a stored position, shown in FIG. 11A, and a deployed position, shown in FIG. 11B. In the stored position, the steps 410 and the bottom step 414 all extend the same distance laterally outward from the frame assembly 12, similarly to the ladder assembly 104. In the deployed position, the steps 410 rotate outward, such steps 410 lower on the stair assembly 402 extend farther outward relative to the frame assembly 12, similarly to the stair assembly 102. In the extended position, the bottom step 414 extends downward, facilitating access to the stair assembly 402 from the ground. The stair assembly 402 facilitates access to the top surface of the deck 70 from the ground while in the stored position and while in the deployed position.

Figure 12:
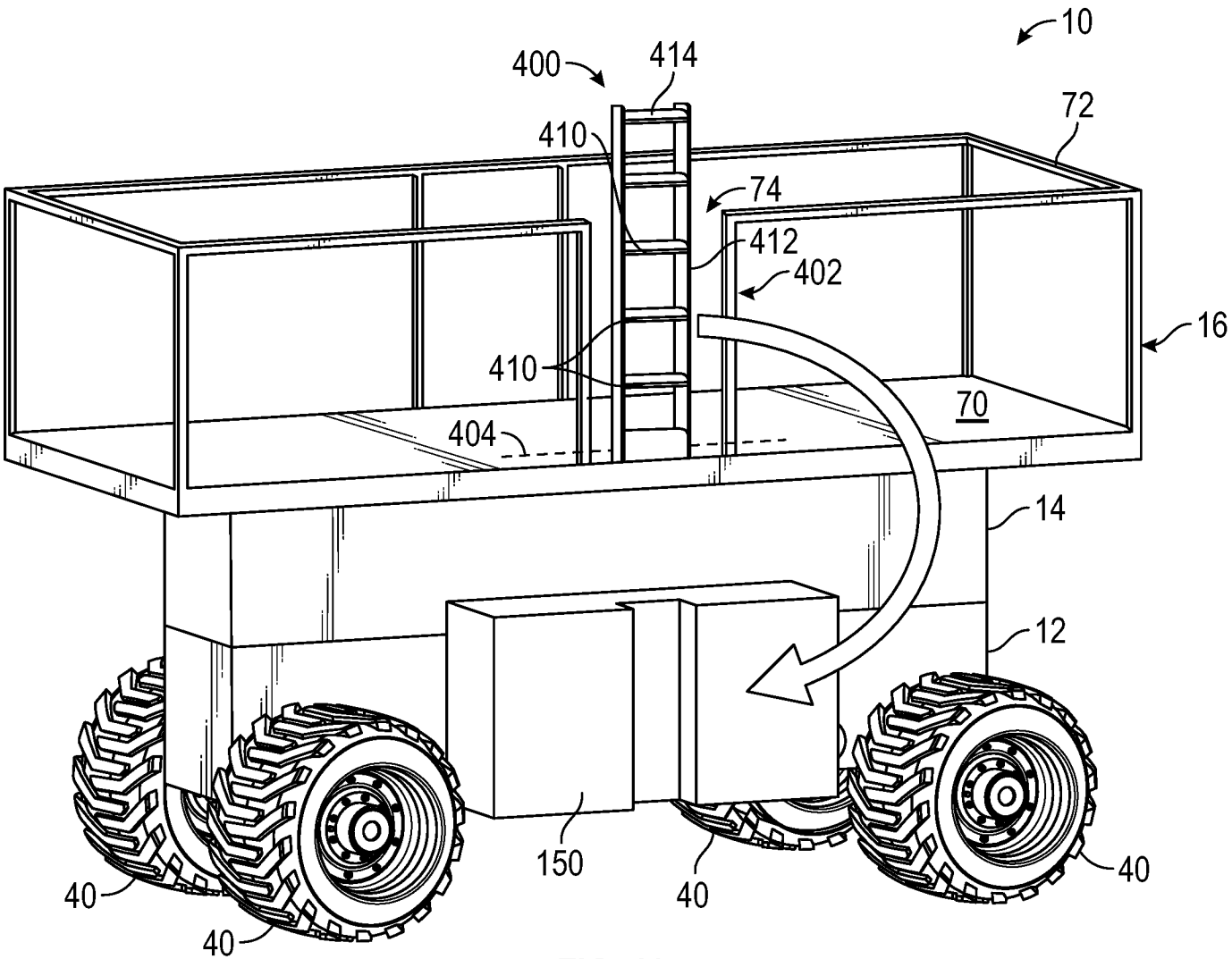
FIG. 12 is a perspective view of a lift device including an access assembly, according to yet another exemplary embodiment.

FIG. 12 shows an alternative embodiment of the lift device 10 and the access assembly 400 shown in FIGS. 11A and 11B. The access assembly 400 shown in FIG. 12 may be substantially similar to the access assembly 400 shown in FIGS. 11A and 11B, except the stair assembly 402 shown in FIG. 12 is pivotally coupled to the deck 70 instead of the frame assembly 12. The stair assembly 402 is additionally pivotable to a secondary stored position, shown in FIG. 12, where the stair assembly 402 is rotated 180 degrees from the stored position to extend across the opening 74. The stair assembly 402 does not facilitate access to the top surface of the deck from the ground while in the secondary stored position.

Figure 13:
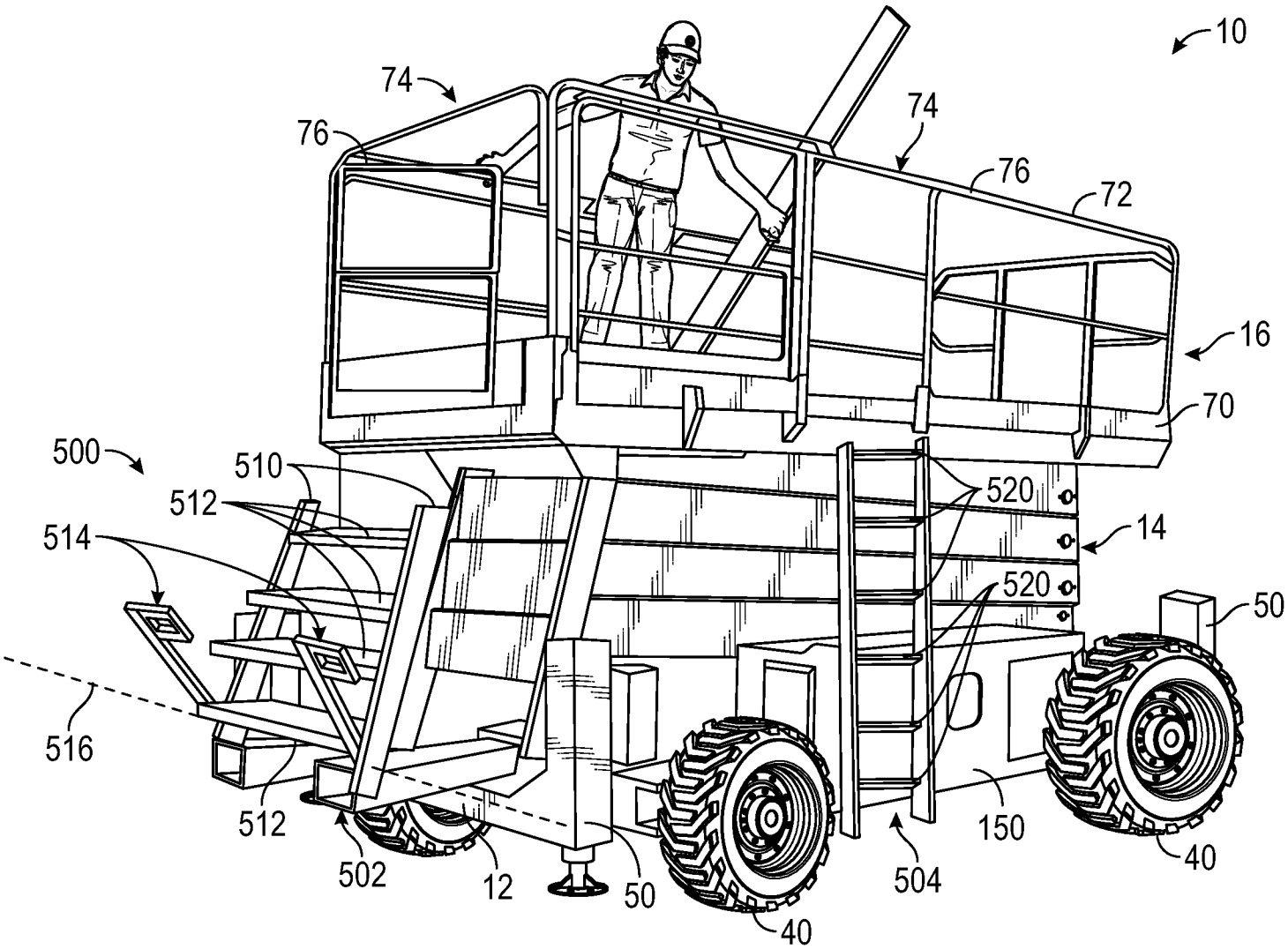
FIG. 13 is a perspective view of a lift device including an access assembly, according to yet another exemplary embodiment.

FIG. 13 shows the lift device 10, according to an alternative embodiment, including an access assembly 500. The lift device 10 and the access assembly 500 shown in FIG. 13 may be substantially similar to the lift device 10 and the access assembly 100 shown in FIGS. 2A-9C, except as otherwise stated. The access assembly 500 includes a stair assembly 502 disposed along a lateral side of the frame assembly 12 and a ladder assembly 504 disposed along a longitudinal side of the frame assembly 12. The stair assembly 502 includes a pair of side plates 510, a number of steps 512, and a pair of handles 514. The stair assembly 502 faces in a longitudinal direction extending outward relative to the frame assembly 12. The steps 512 are fixedly coupled to the side plates 510 and arranged such that the steps 512 lower on the stair assembly 502 extend farther outward relative to the frame assembly 12, similarly to the stair assembly 102. The stair assembly 502 is slidably coupled to the frame assembly 12 and translatable between a stored position and a deployed position, shown in FIG. 13. In the stored position, the steps 512 are arranged proximate the frame assembly 12. When moving to the deployed position, the steps 512 translate away from the frame assembly 12. In some embodiments, the handles 514 are pivotally coupled to the side plates 510 such that they are rotatable about a horizontal axis 516. In some such embodiments, the handles 514 include an engagement system (e.g., a gear mechanism) that couples the rotation of the handles 514 to the translation of the stair assembly 502. By way of example, the handles 514 may be configured such that rotating the handles 514 downward translates the stair assembly 502 outward. The ladder assembly 504 faces laterally outward. The ladder assembly 504 includes a number of rungs 520 that each extend the same distance laterally outward from the frame assembly 12. The rungs 520 are fixed relative to the frame assembly 12, similarly to the fixed portion 108 of the ladder assembly 104.

Although the embodiments shown herein show access assemblies used with scissor lifts, it should be understood that the access assemblies shown herein are useable with all types of work platforms. By way of example, the access assembly 100 may be used with a boom lift having a large platform that cannot be lowered to the ground for easy access.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A lift device, comprising:

a chassis;

a platform disposed above the chassis, the platform including a deck defining a top surface configured to support an operator;

a lift assembly coupling the platform to the chassis and configured to move the platform between a lowered position and a raised position;

a stair assembly coupled to at least one of the platform and the chassis, the stair assembly including a first step and a second step; and a ladder assembly including a third step fixed relative to the chassis and a fourth step fixedly coupled to the stair assembly, wherein the stair assembly is selectively repositionable relative to the chassis between a stored position and a deployed position, and wherein the stair assembly facilitates access to the deck from the ground when in the deployed position; and wherein the ladder assembly facilitates access to the deck from the ground when the stair assembly is in the stored position, wherein the fourth step at least partially extends directly above the third step when the stair assembly is in the stored position, and wherein the fourth step is configured to move away from the third step when the stair assembly is moved to the deployed position.

2. The lift device of claim 1, wherein the stair assembly is pivotally coupled to the chassis, and wherein the stair assembly is selectively rotatable relative to the chassis about a substantially vertical axis between the stored position and the deployed position.

3. The lift device of claim 2, wherein the first step is a bottommost step of the stair assembly, and wherein the first step at least partially extends directly beneath the deck when the stair assembly is in the stored position.

4. The lift device of claim 2, further comprising a plurality of tractive elements coupled to the chassis and configured to drive the lift device in a longitudinal direction, wherein the deck is longer in the longitudinal direction than in a lateral direction oriented perpendicular to the longitudinal direction, and wherein the stair assembly is disposed along a side of the chassis that extends parallel to the longitudinal direction.

5. The lift device of claim 1, wherein the ladder assembly further comprises a fifth step fixed relative to the chassis, wherein the third step extends a first distance outward horizontally relative to the chassis, wherein the fifth step extends a second distance outward horizontally relative to the chassis, and wherein the first distance is equal to the second distance.

6. The lift device of claim 1, wherein, when the stair assembly is in the deployed position, the third step is disposed between the stair assembly and the chassis such that the stair assembly obstructs access to the ladder assembly.

7. The lift device of claim 1, wherein the stair assembly further includes a first railing and a second railing, wherein the first railing and the second railing extend along opposite sides of the first step and the second step, and wherein the first railing and the second railing extend above the first step and the second step when the stair assembly is in the deployed position.

8. The lift device of claim 7, wherein the first railing and the second railing are fixed relative to the first step and the second step, wherein the first railing extends above the top surface of the deck, and wherein the second railing at least partially extends directly beneath the deck when the stair assembly is in the stored position.

9. The lift device of claim 1, further comprising:

a plurality of tractive elements rotatably coupled to the chassis and configured to drive the lift device;

a sensor configured to provide sensing signals relating to the position of the stair assembly; and a controller operatively coupled to the sensor, wherein the controller is configured to limit movement of at least one of the tractive elements in response to determining, based on the sensing signals, that the stair assembly is not in the stored position.

10. The lift device of claim 1, further comprising:

a first operator interface coupled to the platform;

a second operator interface coupled to the chassis; and an actuator configured to move the stair assembly between the stored position and the deployed position in response to at least one of the first operator interface and the second operator interface receiving a command.

11. The lift device of claim 1, wherein the lift assembly is a scissor assembly configured to move the platform in a substantially vertical direction.

12. A lift device, comprising:

a frame assembly;

a platform disposed directly above the frame assembly, the platform including a deck defining a top surface configured to support an operator;

a scissor assembly coupling the platform to the frame assembly and configured to move the platform between a lowered position and a raised position; and a stair assembly coupled to at least one of the platform and the frame assembly, the stair assembly including a first support and a second support extending substantially parallel to one another; and a ladder assembly including a third support fixed relative to the frame assembly and a fourth support fixedly coupled to the stair assembly, wherein the stair assembly is selectively repositionable relative to the frame assembly between a stored position and a deployed position, and wherein the stair assembly facilitates access to the deck from the ground when in the deployed position; and wherein the fourth support at least partially extends directly above the third support when the stair assembly is in the stored position, and wherein the fourth support is configured to move away from the third support when the stair assembly is moved to the deployed position.

13. The lift device of claim 12, wherein, when the stair assembly is in the stored position, the first support extends a first distance outward horizontally relative to the frame assembly and the second support extends a second distance outward horizontally relative to the frame assembly, wherein the first distance is equal to the second distance, and wherein the stair assembly facilitates access to the deck from the ground when in the stored position.

14. The lift device of claim 12, further comprising:

a plurality of tractive elements rotatably coupled to the frame assembly and configured to drive the lift device;

a sensor configured to provide sensing signals relating to the position of the stair assembly; and a controller operatively coupled to the sensor, wherein the controller is configured to limit movement of at least one of the tractive elements in response to determining, based on the sensing signals, that the stair assembly is not in the stored position.

* * * * *